US012179969B2

(12) United States Patent
Anghileri

(10) Patent No.: US 12,179,969 B2
(45) Date of Patent: Dec. 31, 2024

(54) CONTAINER, PACKAGE AND PROCESS OF MAKING THESE LATTER

(71) Applicant: NOVACART S.P.A., Garbagnate Monastero (IT)

(72) Inventor: Gianmario Anghileri, Malgrate (IT)

(73) Assignee: NOVACART S.P.A., Garbagnate Monastero (IT)

( * ) Notice: Subject to any disclaimer, the term of this patent is extended or adjusted under 35 U.S.C. 154(b) by 156 days.

(21) Appl. No.: 17/785,858

(22) PCT Filed: Dec. 16, 2020

(86) PCT No.: PCT/IB2020/062017

§ 371 (c)(1),
(2) Date: Jun. 15, 2022

(87) PCT Pub. No.: WO2021/124141

PCT Pub. Date: Jun. 24, 2021

(65) Prior Publication Data

US 2023/0348128 A1 Nov. 2, 2023

(30) Foreign Application Priority Data

Dec. 17, 2019 (IT) ..... 102019000024322

(51) Int. Cl.
*B65D 5/00* (2006.01)
*B65D 5/20* (2006.01)

(52) U.S. Cl.
CPC ..... *B65D 5/009* (2013.01); *B65D 5/2047* (2013.01)

(58) Field of Classification Search
CPC .... B65D 5/009; B65D 5/2047; B65D 77/003; B65D 5/563; B65D 77/042;
(Continued)

(56) References Cited

U.S. PATENT DOCUMENTS 4,944,451 A * 7/1990 Forbes, Jr. ..... B65D 5/48022 229/114
5,356,070 A * 10/1994 Rigby ..... B65D 5/48022 229/407

(Continued)

FOREIGN PATENT DOCUMENTS

DE 8612900 U1 9/1987
DE 102010042855 A1 4/2012
WO 2019177652 A1 9/2019

OTHER PUBLICATIONS

Search Report dated Apr. 8, 2021 in corresponding International Application No. PCT/IB2020/062017, 4 pages.

(Continued)

*Primary Examiner* — Christopher R Demeree
(74) *Attorney, Agent, or Firm* — MH2 TECHNOLOGY LAW GROUP LLP

(57) ABSTRACT

A container obtained by folding a single flat blank of paper sheet material includes a plurality of hollow elements joined to each other in one piece, each of the hollow elements including a base and a lateral wall; the lateral wall emerges from the base and defines with this latter a seat configured to receive at least one product. The present disclosure also describes a process of making the container and to a use of the same, and also to a package and process of making the same.

20 Claims, 11 Drawing Sheets

(58) Field of Classification Search
CPC ..... B65D 81/3453; B65D 5/48002; B65D 2581/3491; B65D 2577/047; B65D 2577/043; B65D 5/243; B65D 77/046; B65D 21/0233; B65D 21/0234; B65D 5/28
USPC ..... 229/100, 186, 120.17, 125.35, 169, 114, 229/120.16, 160, 170, 407, 915; 206/509, 206/518, 557; 220/23.87
See application file for complete search history.

(56) References Cited

U.S. PATENT DOCUMENTS

| | | | | |
|---|---|---|---|---|
| 5,383,596 | A * | 1/1995 | Gulliver | B65D 5/2004 229/120.16 |
| 5,873,220 | A | 2/1999 | Haraldsson et al. | |
| 6,505,769 | B2 * | 1/2003 | Stone | B65D 5/244 493/63 |
| 7,017,798 | B2 * | 3/2006 | Pope | B65D 77/02 206/509 |
| 8,459,536 | B2 * | 6/2013 | Hanna | B65D 5/22 229/128 |
| 11,827,428 | B2 * | 11/2023 | Zwaga | B65D 5/0085 |
| 2018/0319568 | A1 * | 11/2018 | Tye | B65D 77/286 |

OTHER PUBLICATIONS

Written Opinion dated Apr. 8, 2021 in corresponding International Application No. PCT/IB2020/062017, 5 pages.

* cited by examiner

CONTAINER, PACKAGE AND PROCESS OF MAKING THESE LATTER

CROSS-REFERENCE TO RELATED APPLICATIONS

This is a U.S. National Stage of International Application No. PCT/IB2020/062017 filed Dec. 16, 2020, pending, which claims priority to Italian Patent Application No. 102019000024322 filed Dec. 17, 2019, the entire disclosures of which are hereby incorporated by reference in their entireties.

FIELD OF THE FINDING

The object of the present invention is a container of paper material, a process of making the same, as well as a package and a process of making this latter. Particularly, the container and package object of the present invention can be used for housing food type products, e.g., confectionery products, biscuits, crackers, snacks.

STATE OF THE ART

As it is known the packaging field offers multi-piece pans used for cooking food products, e.g., as the ones described in the U.S. Pat. No. 4,986,432A. These pans comprise a perforated sheet of paper material to which a plurality of distinct baking cups are engaged and configured to receive the dough. While the pans enable, due to the presence of distinct baking cups, to house products having a predetermined height, such pans have a complex multi-piece structure negatively weighing on the manufacturing costs and consequently on the product.

Moreover, cups of paper material are available on the market which comprise a plurality of distinct seats distanced from each other, each of them being provided of a base and a lateral wall developing away from the base in order to define a cavity housing a food product. Such cups are made by stamping a single flat sheet of paper material. Such cups, due to limitations given by the employed manufacturing process, have a limited vertical extension, preventing the cups from containing products having a determined vertical extension; furthermore, this manufacturing process does not enable to make some shapes, this condition negatively weighs on the flexibility in using the same.

The U.S. Pat. No. 4,754,914A describes instead single seat containers, configured to house a food product; such containers are obtained by folding a single paper sheet material. While the containers described in the U.S. Pat. No. 4,754,914A have a structure capable of ensuring to contain products having a substantial vertical development, these are limited by the presence of a single seat and therefore they are provided of different compartments for housing food products. Single seat containers similar to the one described in the U.S. Pat. No. 4,754,914A are also described in the following patent applications: U.S. Pat. No. 5,873,220A, DE8612900U1.

Moreover, from the patent application No. DE 102010042855 A1, are known packages consisting of an outer container suitable to house inside it a tray supporting one or more articles. The tray is formed by three hollow elements aligned along a single direction and integrally joined at an upper flange of each hollow element; the tray is made by folding a blank of paper sheet material. A similar multi-seat tray is described in the patent application PCT No. WO 2019/177652 A1.

While the containers of paper material described in patent applications DE 102010042855 A1 and WO 2019/177652 A1 have a multi-seat structure and a height of the single seat suitable to contain products with a high vertical development, the Applicant has observed that such containers have some drawbacks and therefore the same are improvable in some aspects. Particularly, the beforehand described containers have a low rigidity preventing the same from correctly supporting products with a determined weight. The Applicant has further noted that the containers described in patent applications DE 102010042855 A1 and WO 2019/177652 A1 are not capable of closing the product inside a seat; in order to close a product inside a seat, each container requires a distinct cover suitable to cooperate with the container or an outer package suited to receive the entire container, this condition negatively weighs on the manufacturing costs and on the product.

OBJECT OF THE FINDING

Therefore, it is an object of the present invention to solve at least one of the inconveniences and/or drawbacks of the preceding solutions.

A first object of the present invention consists of providing a multi-compartment container suitable to enable to house products having a high vertical development; particularly, a goal of the present invention consists of providing a container comprising a plurality of compartments distinct from each other, each of them is suitable to contain one or more products and protect the integrity thereof.

A further object of the present invention consists of providing a container having a simple and compact structure having also an optimal strength from the structural point of view. It is a further object of the present invention to provide a container which can be easily and reversibly closed after being opened for the first time.

It is also an object of the invention to provide a container which can be used many times by a consumer and then disposed of by recycling it, as soon as its function is exhausted, without particular issues intrinsic to a no-biodegradability of the material composing it.

These objects and others, which will better appear in the following description, are substantially met by a process of making a container and by a container according to what is disclosed in one or more of the attached claims and/or of the following aspects, considered alone or in combination with each other or in combination with any one of the attached claims and/or in combination with any one of the further aspects or characteristics hereinafter described.

SUMMARY

In an aspect, it is provided a container (1) for housing at least one product (P), optionally of a food type, said container (1) comprising a plurality of hollow elements (2) joined in one piece to each other, wherein each hollow element (2) of said plurality of hollow elements comprises:

a base (3), at least one lateral wall (4) emerging from the base (3) and defining with this latter a seat (5) configured to receive at least one product (P), the lateral wall (4) defining at least one opening delimited by a free edge (6) and configured to enable to introduce and withdraw at least one product (P) from said seat (5).

In an aspect according to the preceding one, the container (1) is made by folding a single flat blank of paper sheet material.

In an aspect according to any one of the preceding aspects, the hollow elements (2) of said plurality of hollow elements are joined at the respective free edges (6).

In an aspect according to any one of the preceding aspects, the container comprises at least one first hollow element (2*a*) of said plurality of hollow elements (2), which comprises at least one flange (14) extending outside the seat (5) from the free edge (6) of the lateral wall (4) of said first hollow element (2*a*), said flange (14) of the first hollow element (2*a*) being joined in one piece to at least one second hollow element (2*b*) of said plurality of hollow elements (2) adjacent to said first hollow element (2*a*). In an aspect according to any one of the preceding aspects, the lateral wall (4) of the first hollow element (2*a*) is interposed between the flange and base of the first hollow element (2*a*) itself.

In an aspect according to any one of the preceding aspects, the second hollow element (2*b*) comprises a flange (14) extending outside the seat (5) from the free edge (6) of the lateral wall (4) of said second hollow element (2*b*) towards the first hollow element (2*a*), wherein the flange (14) of the first hollow element (2*a*) is joined in one piece to the flange (14) of the second hollow element (2*b*). In an aspect according to any one of the preceding aspects, the lateral wall of the second hollow element (2*b*) is interposed between the flange and the base of the same second hollow element (2*b*). In an aspect according to any one of the preceding aspects, the at least one lateral wall (4) of the first hollow element (2*a*) is distanced from the at least one lateral wall (4) of the second hollow element (2*b*).

In an aspect according to any one of the preceding aspects, the container comprises at least one series of hollow elements (2) aligned along a predetermined trajectory (A), optionally rectilinear.

In an aspect according to any one of the preceding aspects, the base (3) of each hollow element (2) lies on a plane.

In an aspect according to any one of the preceding aspects, the base of at least one hollow element lies on a plane parallel to a lying plane of the flange (14) of the same hollow element (2).

In an aspect according to any one of the preceding aspects, the base of the first hollow element (2*a*) lies on a plane, the flange (14) of the first hollow element (2*a*) lying on a plane substantially parallel to a lying plane of the base (3) of the first hollow element (2*a*). In an aspect according to any one of the preceding aspects, the base (3) of the second hollow element (2*b*) lies on a plane, the flange (14) of the second hollow element (2*b*) lying on a plane substantially parallel to a lying plane of the base (3) of the second hollow element (2*b*).

In an aspect according to any one of the preceding aspects, the lateral wall (4) of a hollow element (2) is sloped with respect to the base (3) of the same hollow element (2) by an angle comprised between 90° and 100°, optionally between 91° and 97°, wherein said angle being measured inside the seat (5) of the respective hollow element (2).

In an aspect according to any one of the preceding aspects, the base (3) of each hollow element (2) has a quadrilateral shape. In an aspect according to any one of the preceding aspects, each hollow element has, for each side of the base (3), a lateral wall (4) extending from a peripheral edge delimiting said base (3).

In an aspect according to any one of the preceding aspects, each lateral wall (4) of each hollow element (2) features a quadrilateral shape, still more optionally a square or rectangular or trapezoidal shape. In an aspect according to any one of the preceding aspects, each hollow element (2) features a substantially quadrangular prismatic shape.

In an aspect according to any one of the preceding aspects, the distance between the base (3) and free edge (6) of a hollow element (2) is greater than 20 mm, optionally is comprised between 20 mm and 70 mm; optionally said distance defines a length of the lateral wall (4) of each hollow element (2).

In an aspect according to any one of the preceding aspects, the container comprises an outer perimetral edge (8) having an outer closed profile, opposite to the bases (3) of the plurality of the hollow elements (2) and delimiting an upper access of the container (1), in which the seats of the plurality of hollow elements are defined inside said outer perimetral edge (8).

In an aspect according to any one of the preceding aspects, the outer perimetral edge (8) lies on a plane optionally parallel to the lying planes of the bases of the hollow elements.

In an aspect according to any one of the preceding aspects, the outer perimetral edge (8) is defined at least partially by the free edges (6) of the lateral walls (4) of the plurality of hollow elements (2).

In an aspect according to any one of the preceding aspects, the container comprises at least one panel (9) engaged with at least one segment of the outer perimetral edge (8) of the container (1). In an aspect according to any one of the preceding aspects, the at least one panel (9) is joined in one piece to at least one segment of the outer perimetral edge (8) of the container (1). In an aspect according to any one of the preceding aspects, the at least one panel (9) is arranged at least partially outside the seats (5) of the plurality of hollow elements (2).

In an aspect according to any one of the preceding aspects, the panel (9) is at least partially constrained to at least one lateral wall (4) of at least one hollow element (2). In an aspect according to any one of the preceding aspects, the at least one panel (9) is directly constrained to the at least one lateral wall (4) of the container (1).

In an aspect according to any one of the preceding aspects, the panel (9) extends from the outer perimetral edge (8) towards the bases of the plurality of hollow elements (2) of the container along a predetermined extension direction.

In an aspect according to any one of the preceding aspects, the panel (9) features a height, measured along its extension direction, lower than a distance, measured along the same extension direction, present between the free edge (6) and base (3) of each hollow element.

In an aspect according to any one of the preceding aspects, the ratio of the height of the panel (9) and the lateral wall (4) directly joined in one piece to said panel (9) is lower than 0.75, optionally is lower than 0.5, still more optionally is comprised between 0.45 and 0.2

In an aspect according to any one of the preceding aspects, the at least one panel (9) lies on a plane substantially parallel to a lying plane of the lateral wall (4) to which said panel is directly joined in one piece. In an aspect according to any one of the preceding aspects, the at least one panel (9) lies on a plane substantially parallel to a lying plane of the lateral wall (4) directly supporting said panel.

In an aspect according to any one of the preceding aspects, wherein the at least one panel (9) is stably fixed to the at least one lateral wall (4) directly supporting said panel (9) by glue portions. In an aspect according to any one of the preceding aspects, at least one portion of the at least one panel (9), distanced from the perimetral edge (8), is constrained, optionally by glue portions, to the lateral wall (4)

directly supporting said panel (9). In an aspect according to any one of the preceding aspects, the at least one panel (9) is stably constrained to the at least one lateral wall (4) directly supporting said panel (9) at two zones:

at the perimetral edge (8), at a substantially central zone of the panel (9).

In an aspect according to any one of the preceding aspects, the outer perimetral edge (8) has a quadrilateral shape.

In an aspect according to any one of the preceding aspects, the container (1) comprises at least one first and one second panels (9*a*, 9*b*) connected by and emerging from opposite sides of the outer perimetral edge (8).

In an aspect according to any one of the preceding aspects, the at least one panel (9) comprises at least one first and one second panels (9*a*, 9*b*) connected at opposite sides of the outer perimetral edge (8).

In an aspect according to any one of the preceding aspects, the container (1) comprises at least one panel (9) for each side of the outer perimetral edge (8).

In an aspect according to any one of the preceding aspects, the at least one panel (9) is fixed, optionally by gluing, to the at least one lateral wall (4) at a zone distinct and distanced from the outer perimetral edge (8).

In an aspect according to any one of the preceding aspects, the at least one panel is fixed to a plurality of lateral walls (4) of the container, optionally to two or more lateral walls of adjacent hollow elements (2).

In an aspect according to any one of the preceding aspects, the base (3) and free edge (6) of each hollow element (2) lie on two respective planes substantially parallel to each other, in which the minimum distance between said lying planes of the base and free edge define a depth of the seat of each hollow element (2). In an aspect according to any one of the preceding aspects, said depth is equal to or greater than 20 mm, still more optionally is comprised between 20 and 100 mm.

In an aspect according to any one of the preceding aspects, the at least one panel (9) is hinged to at least one segment of the outer perimetral edge (8). In an aspect according to any one of the preceding aspects, the at least one panel (9) and outer perimetral edge (8) are relatively rotatively movable at least between:

a first operating position in which said panel (9) allows the communication between the openings of the plurality of hollow elements (2) and the outer environment in order to define an open condition of the container (1) suitable to enable the withdrawal and the insertion of products (P), a second operating position in which the panel (9) is arranged at least partially above the openings of the plurality of hollow elements (2) occluding them, in order to at least partially define a closed condition of the container (1) suitable to prevent the withdrawal and insertion of products (P).

In an aspect according to any one of the preceding aspects, the at least one panel (9) comprises at least one first coupling portion (12), wherein the container (1) comprises at least one second coupling portion (13) configured to cooperate with the first coupling portion of the panel (9) in the second operating condition of this latter. In an aspect according to any one of the preceding aspects, the first and second coupling portions (12, 13), in the second operating position of the panel (9) are configured to be engaged with each other in order to lock the panel (9) in the second operating position and consequently to maintain the container in the closed condition.

In an aspect according to any one of the preceding aspects, the first coupling portion (12) comprises a tab, optionally an inserting tab. In an aspect according to any one of the preceding aspects, the tab (12*a*) of the first coupling portion (12) is joined in one piece to the panel (9), optionally emerges from a perimetral edge of said panel (9).

In an aspect according to any one of the preceding aspects, the second coupling portion (13) comprises at least one slot (13*a*) which, in the second operating position of the panel, receives through the first coupling portion (12), optionally the tab (12*a*) of the first coupling portion (12).

In an aspect according to any one of the preceding aspects, the slot (13*a*) of the second coupling portion (13) is distinct and distanced from the free edge (6) of each hollow element (2).

In an aspect according to any one of the preceding aspects, the at least one panel (9) comprises a first and a second panel (9*a*, 9*b*) which, in the second operating position, partially overlap each other, and are configured to completely occlude the openings of the plurality of hollow elements (2).

In an aspect according to any one of the preceding aspects, the first coupling portion (12) comprises at least one tab (12*a*) joined in one piece to the first panel (9*a*). In an aspect according to any one of the preceding aspects, the tab (12*a*) emerges from an outer profile of the first panel (9*a*).

In an aspect according to any one of the preceding aspects, the first and second panels (9*a*, 9*b*) are arranged along sides of the outer perimetral edge (8) oppositely to each other, optionally with respect to the predetermined trajectory (A) of alignment of the series of the plurality of hollow elements.

In an aspect according to any one of the preceding aspects, the second panel (9*b*), in the second operating position, is at least partially interposed between the first panel (9*a*) and at least one hollow element (2).

In an aspect according to any one of the preceding aspects, wherein:

the first coupling portion (12) is carried by the first panel (9*a*), the second coupling portion (13) is carried by the second panel (9*b*).

In an aspect according to any one of the preceding aspects, the second coupling portion (13), optionally the slot of said second coupling portion, carried by the second panel (9*b*), is configured to allow, in the second operating position of the first and second panels (9*a*, 9*b*), the insertion of the tab (12*a*) of the first coupling portion (12) inside a seat (5) of a hollow element (2).

In an aspect according to any one of the preceding aspects, the slot (13*a*) of the second coupling portion (13) is defined at a central zone of the second panel (9*b*).

In an aspect according to any one of the preceding aspects, wherein:

the first coupling portion (12) is carried by the panel (9), the second coupling portion (13) is defined at least on a flange joining in one piece at least two adjacent hollow elements.

In an aspect according to any one of the preceding aspects, the second coupling portion (13), optionally the slot (13*a*) of said second coupling portion (13) is carried by said flange joining in one piece at least two adjacent hollow elements and is configured to allow, in the second operating position of the panel (9), to position the tab (12*a*) in the first coupling portion (12) outside the seats (5) of the hollow elements (2) in interposition between the lateral walls (4) of adjacent hollow elements (2).

In an aspect according to any one of the preceding aspects, the container comprises at least one first and one second series of hollow elements (2) each of them comprises a plurality of hollow elements, in which:

the hollow elements of the first series are aligned along a first trajectory (A), optionally rectilinear, the hollow elements of the second series are aligned along a second trajectory (B), optionally rectilinear, wherein said first and second trajectories are substantially parallel to each other.

In an aspect according to any one of the preceding aspects, the container comprises an intermediate flange (14*a*) joining in one piece the plurality of hollow elements of the first and second series of hollow elements at the free edges of the hollow elements of said first and second series.

In an aspect according to any one of the preceding aspects, the second coupling portion (13) is defined on the intermediate flange (14*a*).

In an aspect according to any one of the preceding aspects, the second coupling portion (13), optionally the slot of the second coupling portion (13*a*), is configured to allow, in the second operating position of the first and second panels (9*a*, 9*b*), to position the tab (12*a*) of the first coupling portion (12) outside the seats (5) of each hollow element (2) in interposition between the first and second series.

In an aspect according to any one of the preceding aspects, the second panel (9*b*) comprises a recess (16) configured to enable, at least in the second operating position of the second panel (9*b*), the first panel (9*a*) to directly face, in the second operating position of said first panel (9*a*), the second coupling portion (13) carried by the intermediate flange (14*a*).

In an aspect according to any one of the preceding aspects, the recess (16) has a convex profile, optionally opened. In an aspect according to any one of the preceding aspects wherein, in the second operating position of the second panel (9*b*), the second coupling portion (13) is arranged at least partially inside the recess (16).

In a further aspect, it is provided a process of making a container (1) according to any one of the preceding aspects. In an aspect according to any one of the preceding aspects, the process comprises at least the following steps:

predisposing a flat blank (50) of paper sheet material comprising at least one first and one second sheets (50*a*, 50*b*), wherein each of said first and second sheets (50*a*, 50*b*) comprises at least:

a central sheet (51), a lateral sheet (52) joined in one piece to the central sheet (51) and emerging from a perimetral edge of this latter, wherein the first and second sheets (50*a*, 50*b*) are joined in one piece at respective lateral sheets (52), folding the at least one lateral sheet (52) and the central sheet (51) of the first sheet (50*a*) with respect to each other in order to define a hollow element (2), folding the at least one lateral sheet (52) and the central sheet (51) of the second sheet (50*b*) with respect to each other in order to define a further hollow element (2).

In an aspect according to any one of the preceding aspects wherein after the folding step:

the at least one lateral sheet (52) of the first and second sheets (50*a*, 50*b*) define respectively the at least one lateral wall of the hollow elements (2), the central sheets (51) of the first and second sheets (50*a*, 50*b*) define the bases (3) of said hollow elements (2).

In an aspect according to any one of the preceding aspects wherein the first sheet (50*a*) comprises a plurality of lateral sheets (52) emerging from the respective central sheet (51). In an aspect according to any one of the preceding aspects wherein the first sheet (50*a*) further comprises at least one lateral connecting sheet (53) carried by at least one of the lateral sheets (52) of the first sheet (50*a*), wherein, following the step of folding the lateral sheets (52) with respect to the central sheet (51) of the first sheet (50*a*), said at least one lateral connecting sheet (53) carried by a lateral sheet (52), is constrained, optionally by gluing, to an adjacent lateral sheet (52) in order to stably maintain the hollow element (2) in a tridimensional configuration. In an aspect according to any one of the preceding aspects, the second sheet (50*b*) comprises a plurality of lateral sheets (52) emerging from the respective central sheet (51), wherein the second sheet (50*b*) further comprises at least one lateral connecting sheet (53) carried by at least one of the lateral sheets (52) of the second sheet (50*b*), wherein, after the step of folding the lateral sheets (52) with respect to the central sheet (51) of the second sheet (50*b*), said at least one lateral connecting sheet (53) carried by a lateral sheet (52), is constrained, optionally by gluing, to an adjacent lateral sheet (52) in order to stably maintain the hollow element (2) in a tridimensional configuration.

In an aspect according to any one of the preceding aspects wherein the respective central sheets (51) of the first and second sheets (50*a*, 50*b*) have a quadrangular polygonal shape, wherein, from each side of the quadrangular polygon emerge at least one lateral sheet (52).

In an aspect according to any one of the preceding aspects wherein the central sheets (51) of the first and second sheets (50*a*, 50*b*) are divided from each other at least by a lateral sheet (52) of the first sheet (50*a*) and by a lateral sheet (52) of the second sheet (50*b*).

In an aspect according to any one of the preceding aspects, wherein the at least one lateral sheet (52) respectively of the first and second sheets (50*a*, 50*b*) has a trapezoidal shape.

In an aspect according to any one of the preceding aspects, wherein the first sheet (50*a*) comprises at least one lateral connecting sheet (53) placed side by side between two immediately adjacent lateral sheets (52) of the first sheet (50*a*), and wherein the second sheet (50*b*) comprises at least one lateral connecting sheet (53) placed side by side between two immediately adjacent lateral sheets (52) of the second sheet (50*b*).

In an aspect according to any one of the preceding aspects, wherein each lateral connecting sheet (53) of the first and second sheets (50*a*, 50*b*) features a triangular shape.

In an aspect according to any one of the preceding aspects, wherein the blank (50) comprises at least one central connecting sheet (55) delimited by a perimetral edge and joined in one piece to a lateral sheet (52) of the first sheet (50*a*) along a first segment of said perimetral edge, and wherein said central sheet (55) is further joined in one piece to a lateral sheet (52) of the second sheet (50*b*) along a second segment of the perimetral edge of the central connecting sheet (55), oppositely to the first segment, wherein, following the step of folding the first and second sheets (50*a*, 50*b*), the central connecting sheet (55) defines at least partially a flange of at least one hollow element (2).

In an aspect according to any one of the preceding aspects, the first and second sheets (50*a*, 50*b*) comprise at least one peripheral sheet (54), joined in one piece to at least one lateral sheet (52) respectively of the first and second sheets (50*a*, 50*b*), wherein, following the step of folding the first and second sheets (50*a*, 50*b*), said peripheral sheet defines the at least one panel (9) of the container.

In an aspect according to any one of the preceding aspects, at least one lateral sheet (52) of the first sheet (50*a*) is arranged between the central sheet (51) and peripheral sheet (54) of the first sheet (50*a*), and wherein at least one lateral sheet (52) of the second sheet (50*b*) is arranged in interposition between the central sheet (51) and peripheral sheet (54) of the second sheet (50*b*).

In an aspect according to any one of the preceding aspects, the blank (50) has a first and second surfaces, wherein:

the first surface, following the step of folding the first and second sheets (50*a*, 50*b*), defines a surface of the seat (5) of the hollow element suitable to receive a product (P), the second surface, following the step of folding the first and second sheets (50*a*, 50*b*), defines an outer surface of the container (1).

In an aspect according to any one of the preceding aspects wherein, following or simultaneously with the step of folding the lateral sheet (52), the process comprises a step of folding each peripheral sheet (54) respectively of the first and second sheets (50*a*, 50*b*) with respect to the lateral sheet (52) so that the second surfaces of the peripheral sheet and of the lateral sheet face and at least are partially in contact with each other.

In an aspect according to any one of the preceding aspects, wherein, following the step of folding each peripheral sheet (54), the process comprises the step of:

overlapping at least partially a peripheral sheet (54) of the first sheet (50*a*) on an adjacent peripheral sheet (54) of the second sheet (50*b*), constraining, for example by gluing, a peripheral sheet (54) of the first sheet (50*a*) to an adjacent peripheral sheet (54) of the second sheet (50*b*).

In an aspect according to any one of the preceding aspects, the first sheet (50*a*) comprises a plurality of peripheral sheets (54) emerging oppositely to the central sheet (51) of the first sheet (50*a*), wherein each of said peripheral sheets (54) of the first sheet (50*a*) is joined in one piece to a lateral sheet (52) of the first sheet (50*a*) and is constrained to this latter, optionally by gluing, at the second surface of the blank (50), and wherein the second sheet (50*b*) comprises a plurality of peripheral sheets (54) emerging oppositely to the central sheet (51) of the second sheet (50*b*) wherein each of said peripheral sheets (54) of the first sheet (50*a*) is joined in one piece to a lateral sheet (52) of the second sheet (50*b*) and is constrained to this latter, optionally by gluing, at the second surface of the blank (50).

In an aspect according to any one of the preceding aspects, the first sheet (50*a*) comprises at least one tab (56) supported by at least one peripheral sheet (54) and emerging from a perimetral edge delimiting this latter, wherein said tab (56) is suitable to define, following the step of folding the blank, the tab (12*a*) of the first coupling portion (12) of the container.

In an aspect according to any one of the preceding aspects, the second sheet (50*b*) comprises at least one opening (57) obtained following at least one step of cutting a peripheral sheet (54) of the second sheet (50*b*) opposite to the peripheral sheet (54) carrying the tab (56), wherein said cutting step, following the step of folding the blank, defines the slot (13*a*) of the second coupling portion (13).

In an aspect according to any one of the preceding aspects, the blank (50) comprises at least one third and at least one fourth sheets (50*c*, 50*d*) made according respectively to the first and second sheets (50*a*, 50*b*) according to any one of the preceding aspects, wherein the first and second sheets are aligned along a first direction, while the third and fourth sheets are aligned along a second direction parallel to the first direction. In an aspect according to any one of the preceding aspects, the third and fourth sheets are joined in one piece and are placed side by side respectively to the first and second sheets.

In an aspect according to any one of the preceding aspects, the blank (50) comprises at least one first joining sheet (58*a*) joining in one piece the first and third sheets, the blank further comprising at least one second joining sheet (58*b*) joining in one piece the second and fourth sheets, wherein said first joining sheet (58*a*) is joined in one piece to respective lateral sheets (52) of the first and third sheets (50*a*, 50*c*) along a first segment of the perimetral edge of the joining sheet (58), and wherein said second joining sheet (58*b*) is further joined in one piece to respective lateral sheets (52) of the second and fourth sheets (50*b*, 50*d*) along a second segment of the perimetral edge of the joining sheet (58), opposite to the first segment, in order to define the intermediate flange (14*a*) following the step of folding the first and second blanks (50*a*, 50*b*).

In an aspect according to any one of the preceding aspects, the joining sheet (58) comprises at least one opening (57) obtained after at least one step of cutting this latter in order to define the slot (13*a*) of the second coupling portion (13).

In an aspect according to any one of the preceding aspects, the process comprises at least one step of cutting a peripheral sheet (54) of the blank (50) in order to define a recess (16).

In an aspect according to any one of the preceding aspects, the blank is obtained by die cutting a single precursor flat sheet of paper sheet material. In an aspect according to any one of the preceding aspects, the die cutting step defines, at the joining edges between each central sheet and lateral sheet, the creasing configured to guide the folding of the respective sheets from the flat configuration to the folded one in which said sheets define the hollow elements of the container.

In a further aspect, it is provided a package (100) comprising:

at least one case (17) made sheet material comprising a housing compartment (20) having a substantially closed volume, at least one container (1) according to any one of the preceding aspects, at least one product, for example of the food type, arranged inside at least one seat of at least one hollow element (2) of the container, wherein the container (1) containing the at least one product (P) is disposed inside the housing compartment of the case (17).

In an aspect according to the preceding aspect, the case (17) comprises at least one end closure portion (18) joined in one piece to a lateral wall (19) in order to define a tubular element inside which said container (1) is arranged.

In an aspect according to any one of the preceding aspects, the at least one end closure portion (18) of the case (17) comprises a first and a second end closure portions (18*a*, 18*b*) opposite to each other.

In an aspect according to any one of the preceding aspects, the case is made of at least one of the following materials: plastics, aluminum, paper.

In an aspect according to any one of the preceding aspects, the container is housed in the case with the second panel (9*b*) being arranged above at least part of the plurality of hollow elements (2) and the first panel being placed side by side if the at least one lateral wall of the at least one part of the hollow elements.

In a further aspect, it is provided a process of making a package according to any one of the preceding aspects, said process comprising at least the following steps of:

making a container (1) according to any one of the preceding aspects, by the process of making a container according to any one of the preceding aspects, predisposing at least one product, optionally of a food type, inside at least one hollow element of the container (1), predisposing the case (17), predisposing the container (1) inside the case (17).

In an aspect according to the preceding aspect, the step of predisposing the case comprises the following sub-steps:

predisposing a flat sheet;

folding said flat sheet in order to define a tubular element featuring at least one head opening;

constraining, optionally by sealing, said tubular element at the head opening in order to define the at least one end closure portion.

In an aspect according to any one of the preceding aspects, the step of folding the flat sheet of the case defines a tubular element having two opposite end portions. In an aspect according to any one of the preceding aspects, the process the insertion of the container inside the tubular element before the step of constraining the tubular element itself at both the end openings, the step of constraining the tubular element defining the end closed portions of the case joined in one piece by the lateral wall.

In an aspect according to any one of the preceding aspects, wherein the flat sheet of the case (17) is at least partially made of plastic material. In an aspect according to any one of the preceding aspects, wherein the step of constraining the end portions (18) of the tubular element is performed following the step of heat sealing the same end portions (18) to each other.

In a further aspect, it is provided a use of the container according to any one of the preceding aspects for containing food products, optionally comprising at least one selected in the group among: confectionaries, biscuits, crackers, snacks.

BRIEF DESCRIPTION OF THE DRAWINGS

Some embodiments and some aspects of the invention will be described in the following with reference to the attached drawings given only in an indicative and therefore non-limiting way, wherein.

DEFINITIONS AND CONVENTIONS

It is worth noting that in the present detailed description the parts illustrated in the different figures are indicated by the same numeral references. The figures could illustrate the object of the invention by not-to-scale representations; consequently, parts and components illustrated in the figures regarding the object of the invention, could only refer to schematic representations.

The term "product" means an article or a composition of articles of any kind. For example, the product can be in a solid, liquid or gel state, in other words as two or more of said aggregation states. Moreover, the product can be understood as a package, for example a blister, containing a plurality of articles. The product can comprise: drugs, beauty products, dishwasher and washing machine capsules, house cleaning products and laundry cleaning products (e.g., detergents), foodstuff, and cigarettes.

The term "paper material" means paper or paperboard, for example featuring at least 50% by weight, optionally at least 70% by weight of an organic material comprising one or more among cellulose, hemicellulose, lignin, derivatives of lignin. The paper material can be a sheet material having a grammage comprised between 100 and 500 g/m2. The sheet paper material can be coated at least partially by a plastic material coating, for example a film, destined to: reinforce the paper sheet material, define a water and/or humidity barrier. The coating can have a thickness varying between 10 μm and 50 μm and can be made by one or more of the following materials: LDPE, HDPE, PP, PE.

The term "blank" refers to a semi-finished product of sheet material, for example of paper sheet material, foldable on itself for completing a container. The blank can be in a single piece and obtainable by die cutting a single sheet.

The term "folded configuration of the blank" means a configuration in which the blank is folded to form a container.

The term "sheet material" means a material featuring two dimensions, for example the length and width, substantially greater than a third dimension, such as the thickness.

DETAILED DESCRIPTION

Container 1

The reference number 1 generally indicates a container of paper material for housing at least one food product P made by the steps of folding a single flat sheet of paper material.

Figure 1:
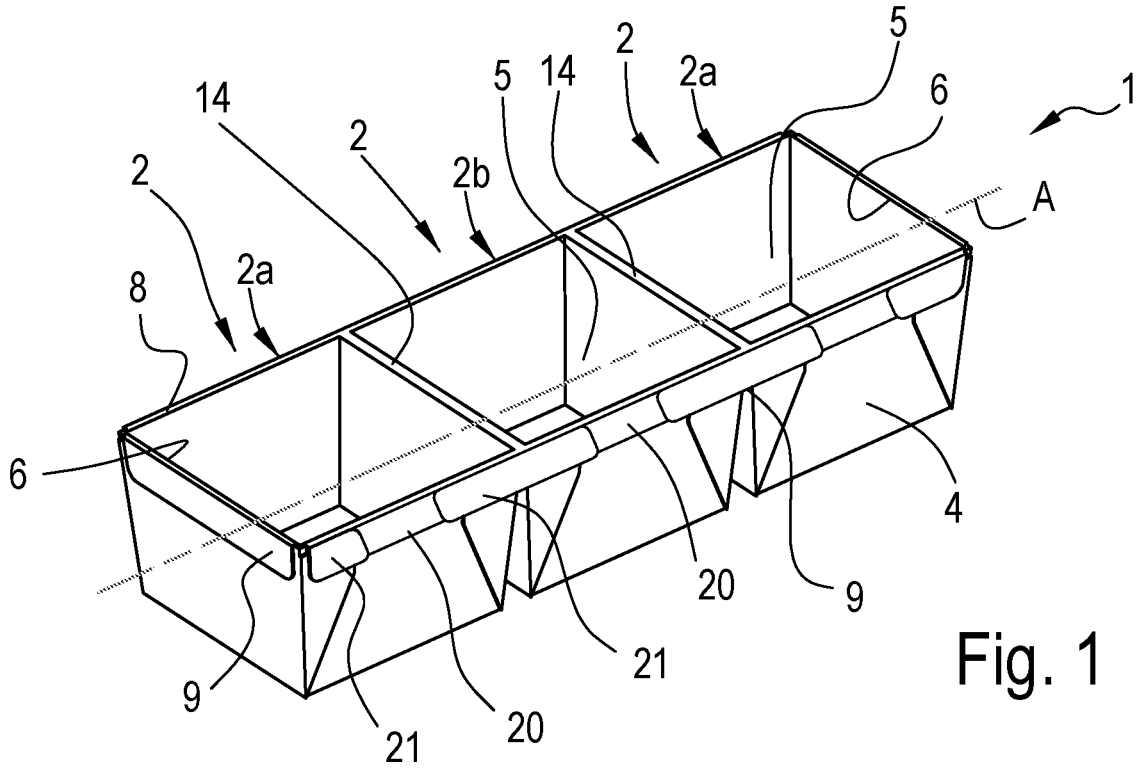
FIGS. 1 and 2 are perspective views respectively of a container and a stack of containers according to the present invention.

The container 1 shown in FIG. 1 comprises a plurality of hollow elements 2 in a substantially prismatic quadrangular shape, each of them can comprise a base 3 featuring a quadrangular shape delimited by a peripheral edge and developing along a horizontal plane, each hollow element 2 comprises at least one lateral wall 4 emerging from the base 3 and defining with this latter a seat 5 configured to receive at least one product P. Each lateral wall 4 has a quadrilateral shape, optionally squared, rectangular or trapezoidal one, engaged, on one side, to the peripheral edge of the base 3 and defining, oppositely, a free edge 6 suitable to define an opening configured to allow the introduction and withdrawal of at least one product P from the seat 5. The at least one lateral wall 4 has an inclination with respect to the base 3 of the hollow element 2 itself equal to an angle comprised between 90° and 100°, optionally between 91° and 97°, measured inside the seat 5 of the respective hollow element 2. The inclination of the lateral walls 4 of each hollow element 2 allows the same to receive inside a further hollow element 2 of a different container 1; consequently, due to the inclination of the lateral walls 4, the container 1 according to the present invention, can be stacked as illustrated in FIG. 2 in order to make easier the storage and transport.

The free edge 6 of each hollow element 2, has a distance with respect to the base, which is considered equal to the length of the lateral wall 4, greater than 20 mm, optionally comprised between 20 mm and 70 mm. Moreover, it is useful to note, as shown in the attached figures, that the base 3 and free edge 6 of each hollow element lie on respective planes substantially parallel to each other, in which the minimum distance between said lying plane of the base and free edge define a depth of the seat of each hollow element 2 equal to or greater than 20 mm, optionally comprised between 20 mm and 100 mm.

In a first embodiment of the invention (not illustrated in the attached figures), the container 1 comprises at least a series of hollow elements 2 defined by at least one first and one second hollow elements 2*a*, 2*b* aligned along a predetermined trajectory A, optionally rectilinear, in which at least a lateral wall 4 of the first hollow element 2*a* is distanced from at least one lateral wall 4 of the second hollow element 2*b*. Indeed, in the first embodiment, the container comprises only two hollow elements placed side by side.

Figure 2:
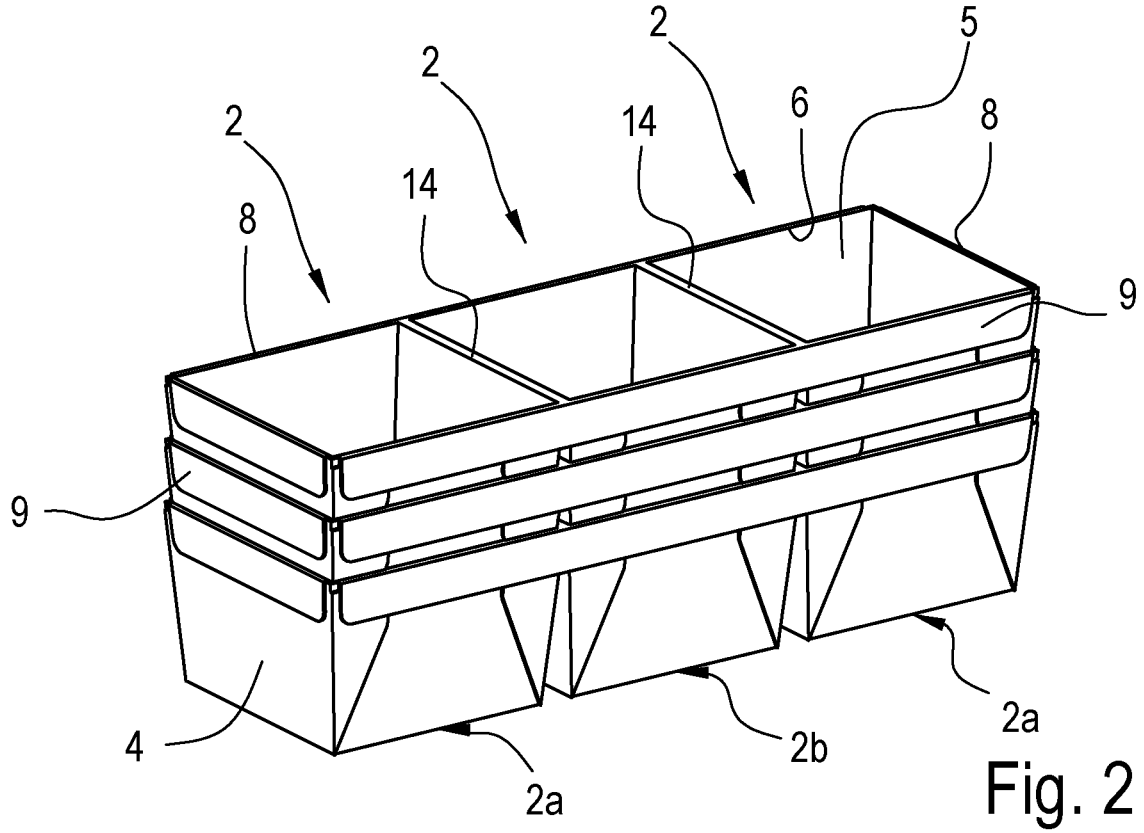
Figure 3:
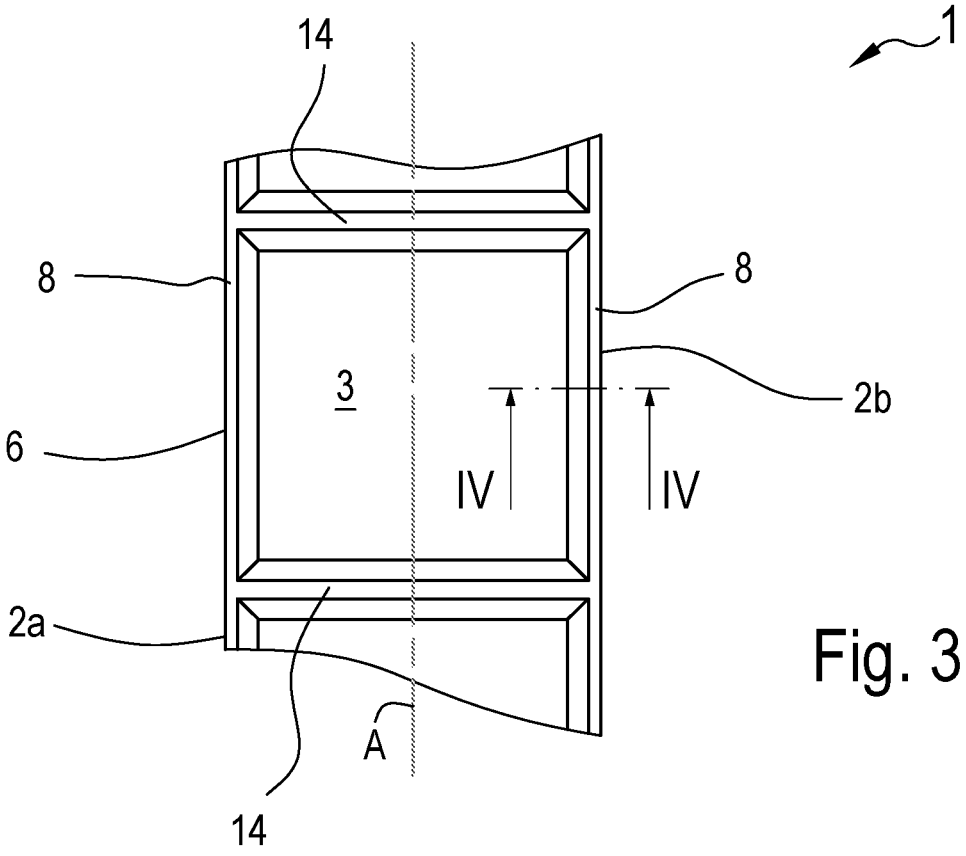
FIG. 3 is a detailed top view of a container according to the present invention.

FIGS. 1, 2, 6-9 show a second embodiment of the container 1 comprising three hollow elements 2 aligned along the predetermined trajectory A. In particular, FIG. 2 shows a plurality of containers 1 according to the second embodiment, which are vertically stacked, in which each hollow element 2 of a container is housed inside the seat 5 of a hollow element 2 of an underlying container.

A third embodiment of the invention, shown in Figures from 11 to 17, on the contrary refers to a container 1 comprising at least one first and one second series of hollow elements 2 respectively aligned along a first and second trajectories A, B, optionally rectilinear, substantially parallel to each other. Indeed, each series of the container 1 according to the third series comprises a plurality of hollow elements 2 so that the container substantially defines an array of hollow elements 2. Figures from 11 to 17 show in a non-limiting way a container comprising only two series of hollow elements, each of them comprises three hollow elements aligned along a predetermined direction; it is not excluded the possibility of providing a greater number of series (in other words greater than two) in which each series comprises a number of hollow elements 2 equal to or greater than two (for example comprised between 2 and 50).

In each embodiment of the invention, the hollow elements 2 are engaged with each other in correspondence of at least part of the respective free edges 6. In particular, the first hollow element 2*a* can comprise at least one flange 14 extending outside the seat 5 from the free edge 6 of the same first hollow element 2*a*, joined in one piece to at least to the second hollow element 2*b*. In other words, the flange 14 is interposed between the lateral walls 4 respectively of the first and second hollow elements 2*a*, 2*b*. Still in other words, the lateral wall 4 of the first hollow element 2*a* is interposed between the flange 14 and base 3 of the same first hollow element 2*a*. Analogously to the first hollow element 2*a*, the second hollow element 2*b* comprises also a flange 14 extending outside the seat 5 from the free edge 6 of the same second hollow element 2*b*, towards the first hollow element 2*a*, joined in one piece to the flange 14 of the first hollow element 2*a*. Moreover, it is useful to observe, as shown for example in FIGS. 1, 2, 11, and 15, the flange 14 of the first and second hollow elements 2*a*, 2*b* lies on a plane parallel to the lying plane of the base 3 of each hollow element 2. The above cited has of the first and second hollow elements 2*a*, 2*b*, illustrated in the second embodiment of the container 1, are typical of all the embodiments of the container 1 according to the present invention; in other words, the features of the first and second hollow elements 2*a*, 2*b* are typical of each pair of immediately adjacent hollow elements 2 of the container and are joined in one piece to each other. In addition, the container 1, according to the third embodiment, comprises an intermediate flange 14*a* which joins in one piece two series of hollow elements 2 placed side by side to each other (see FIG. 11, for example).

The container 1 shown in the attached figures further comprises an outer perimetral edge 8, which has a substantially quadrilateral shaped closed profile opposite to the bases 3 of the plurality of hollow elements 2. The outer perimetral edge 8 delimits an upper access to the seats 5 of each hollow element 2, which are completely defined inside the same outer perimetral edge 8. In detail, the outer perimetral edge 8 can be defined by at least part of the free edges 6 of the lateral walls 4 of the plurality of hollow elements 2, developing on a lying plane parallel to the lying plane of the bases of the hollow elements 2.

The container 1 can further comprise at least one panel 9 joined in one piece to at least one segment of the outer perimetral edge 8 of the container 1 and arranged at least partially outside each seat 5 of a hollow element 2. As it will better outlined in the description of a process of making the container 1, each panel 9 can be formed by at least two elementary panels 20 (FIG. 1) each of them extends respectively from the free edge 6 of the first and second hollow elements 2*a*, 2*b*. The elementary panel 20 of the first hollow element 2*a* can therefore comprise at least one joining portion 21, which is configured to engage, optionally by gluing, a respective joining portion 21 of the elementary panel 20 of the second hollow element 2*b*, for defining the panel 9.

In a first configuration, the panel 9 is arranged next to a lateral wall 4 of at least one hollow element 2, optionally is engaged with a lateral wall 4; in such configuration, overlapping the panel 9 on at least part of the lateral wall 4 allows to increase the structural rigidity of the container 1.

In particular, in the first configuration, the panel 9 extends from the outer perimetral edge 8 towards the bases 3 of the plurality of hollow elements 2 of the container along a predetermined extension direction. The container 1 can comprise a plurality of panels 9 extending from each side of the perimetral edge 8 towards the base 3. Along the predetermined extension direction, it is therefore possible to define a height of the panel 9, which is lower than a distance present between the free edge 6 and base 3 of each hollow element measured in the same way along the same extension direction. In other words, the ratio of the height of panel 9 and the lateral wall 4, directly joined in one piece to the panel, is lower than 0.75, optionally is lower than 0.5, still more optionally is comprised between 0.45 and 0.2

Figure 4:
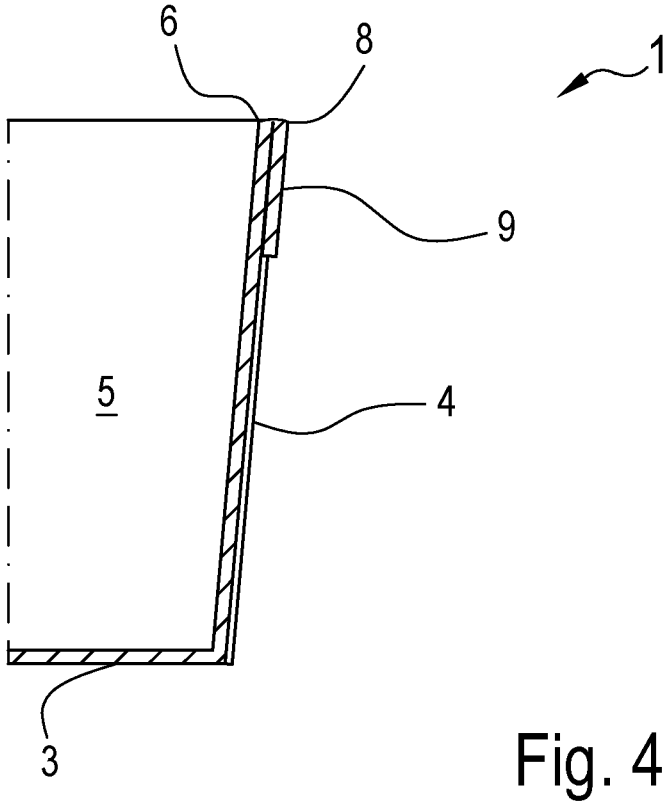
FIG. 4 is a detailed view, according to line IV-IV, of the container in FIG. 3.

The panel 9, according to the first configuration, is for example illustrated in FIGS. 1, 2 and 4, associated to the container 1 according to the second embodiment; obviously, it is not excluded the provision of the panel 9 as in the first configuration, associated to the container according to the above described first and/or third embodiments.

According to a second configuration, the at least one panel 9 is engaged with the outer perimetral edge 8 and is movable with respect to this latter by rotating at least between a first and second operating positions. In the first operating position, the panel 9 allows the communication between the openings of the hollow elements 2 and the outer environment, in order to define an open condition of the container 1 suitable to enable the withdrawal and insertion products P. Vice versa, in the second operating position, the panel 9 is arranged at least partially above the openings of the plurality of hollow elements 2, occluding at least partially them, for defining a closed condition of the container suitable to prevent the products P from being withdrawn.

Figure 8:
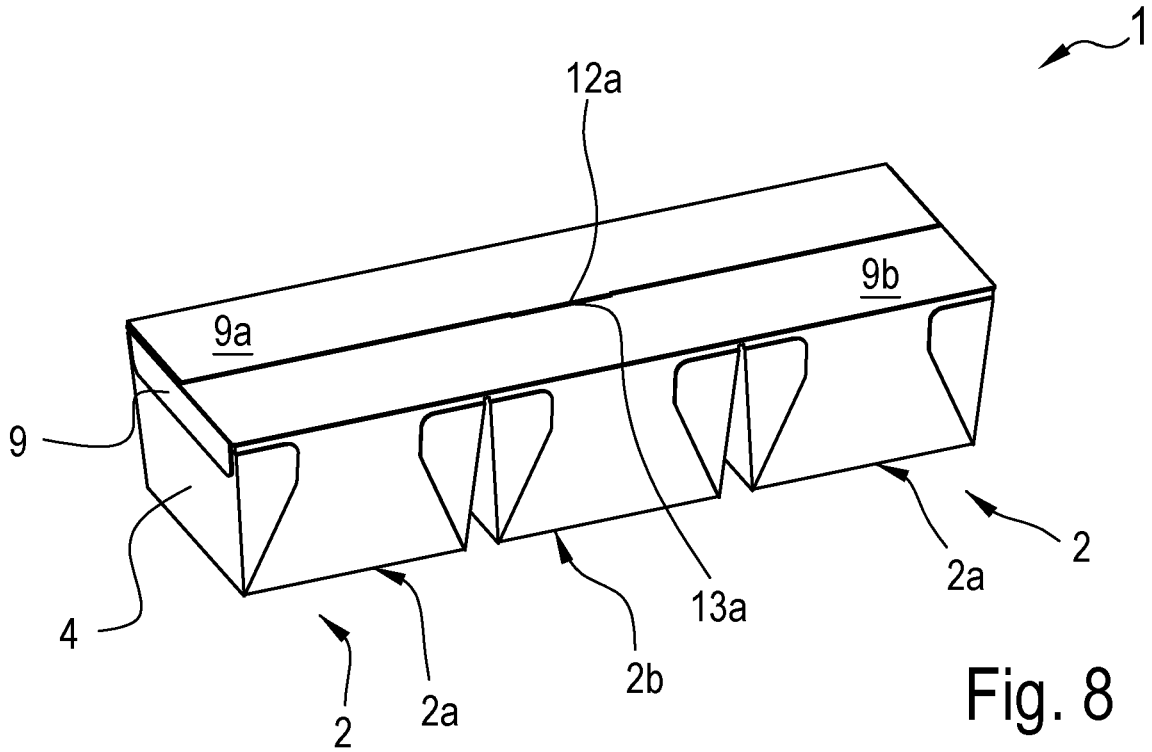
Figure 9:
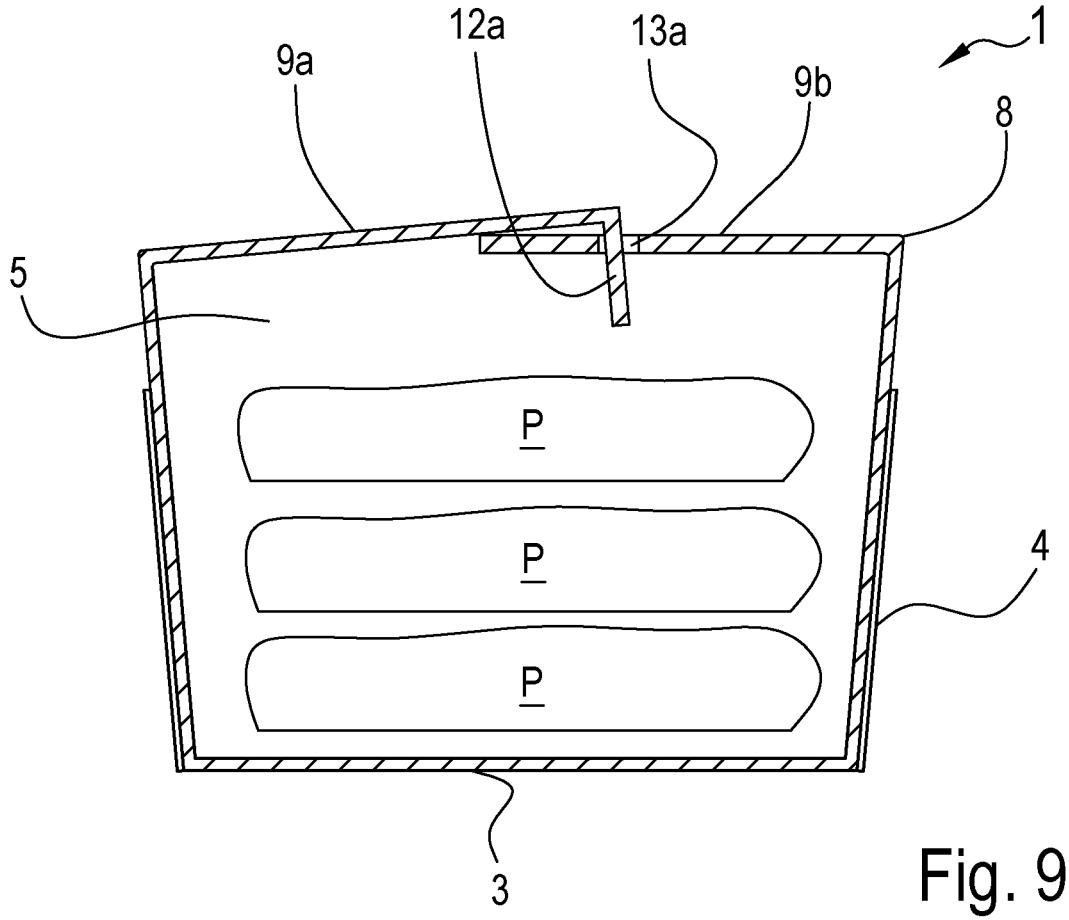
FIG. 9 is a schematic view of a cross-section of the container illustrated in FIGS. 7 and 8 arranged in a closed condition.
Figure 10:
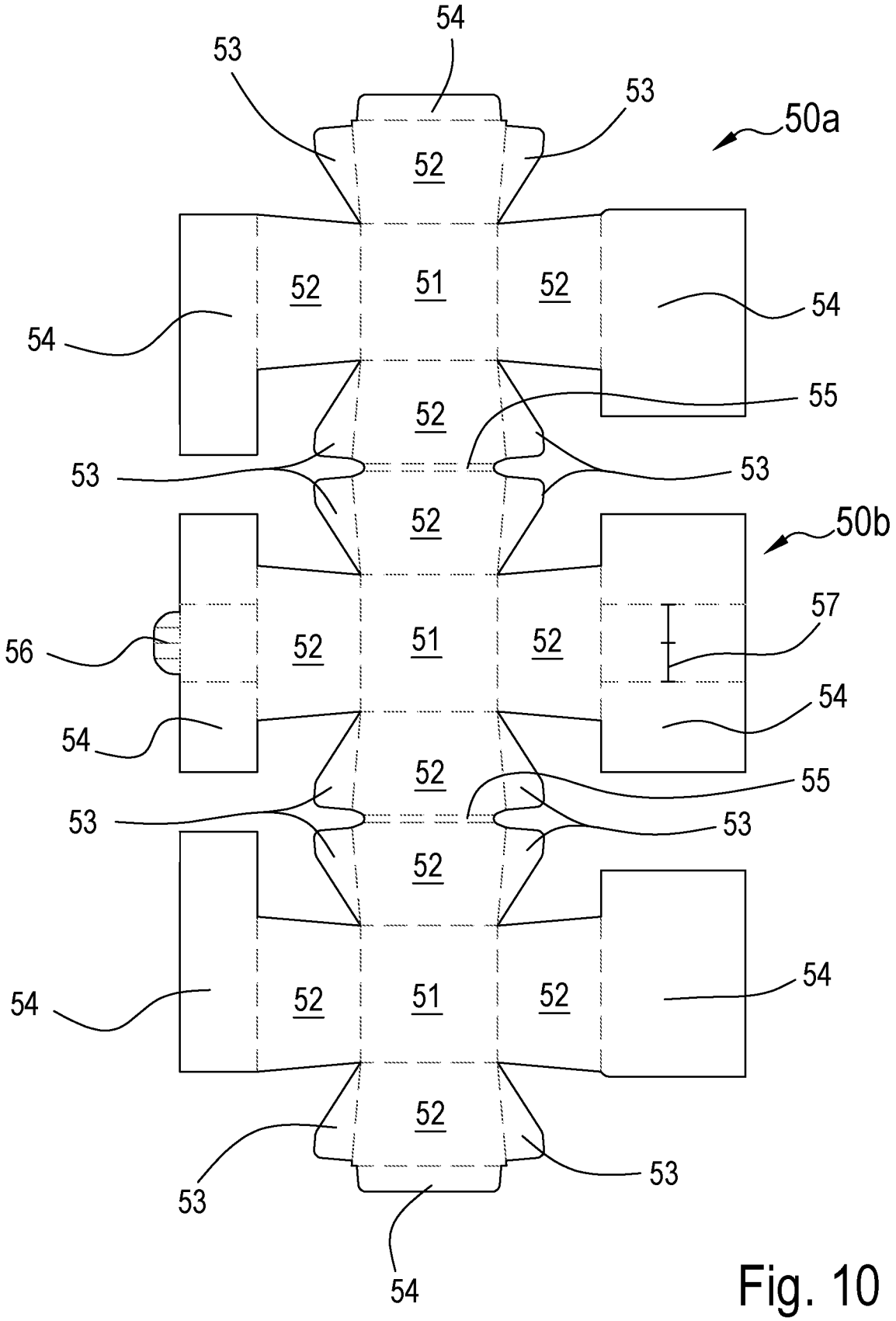
FIG. 10 is a schematic view of a blank for making the container illustrated in Figure from 6 to 9.
Figure 13:
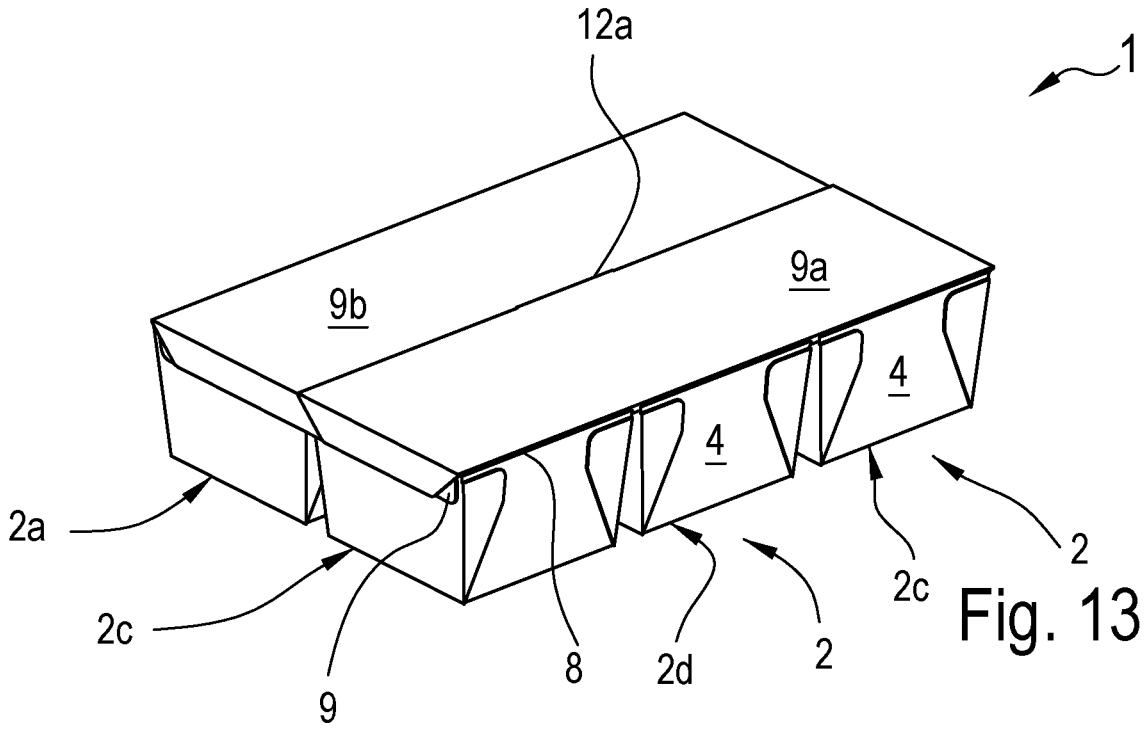
FIG. 13 illustrates the container in FIG. 11 arranged in a closed condition.

The panel 9 can comprise at least one first and one second panels 9*a*, 9*b*, connected to and emerging from opposite sides of the outer perimetral edge with respect to the predetermined aligning trajectory A of the hollow elements 2. However, the container 1 can comprise at least one panel 9 for each side of the outer perimetral edge 8. The first and second panels 9*a*, 9*b* are movable between a first operating position, illustrated in FIGS. 6 and 11, in which they are configured to enable to insert the products P inside the seats 5 of each hollow element 2 (FIG. 7), and a second operating position in which they are at least partially overlapped on each other and configured to completely occlude the openings of the plurality of hollow elements 2 (FIGS. 8 and 13). Moreover, it is useful to note as the second panel 9*b*, arranged in the second operating position of FIG. 9, is at least partially interposed between the first panel 9*a* and at least one hollow element 2 completely occluding the openings of each hollow element 2.

The container 1 can comprise only a panel 9 according to the first configuration, as illustrated in FIG. 1 for example, or can comprise the panel 9 according to the second configuration (movable panel). It is not excluded the possibility of providing a container 1 comprising at least one panel 9 according to the first configuration and at least one panel 9 according to the second configuration; for example, FIGS. 6, 8, 11, and 13 illustrate a container 1 comprising the first and second panels 9*a*, 9*b* according to the second configuration (movable with respect to the perimetral edge 8) engaged on the opposite sides of the perimetral edge 8 and a further pair of opposite panels 9 according to the first configuration, in other words fixed to a lateral wall 4 of at least one hollow element 2; particularly, the pair of panels 9 fixed to the lateral wall 4 placed side by side to the first and second movable panels 9*a*, 9*b*. In other words, two opposite sides of the perimetral edge 8 stably support the first and second panels 9*a*, 9*b* are movable, while the other two opposite sides of the perimetral edge stably support the panel 9 in the first configuration, in other words fixed to the lateral wall 4 of a hollow element 2.

The container 1 can further comprise at least one first and one second coupling portions 12, 13 configured to engagingly cooperate with each other, enabling the panel 9 to remain in the second operating position and therefore to maintain the container 1 in the closed condition.

Figure 6:
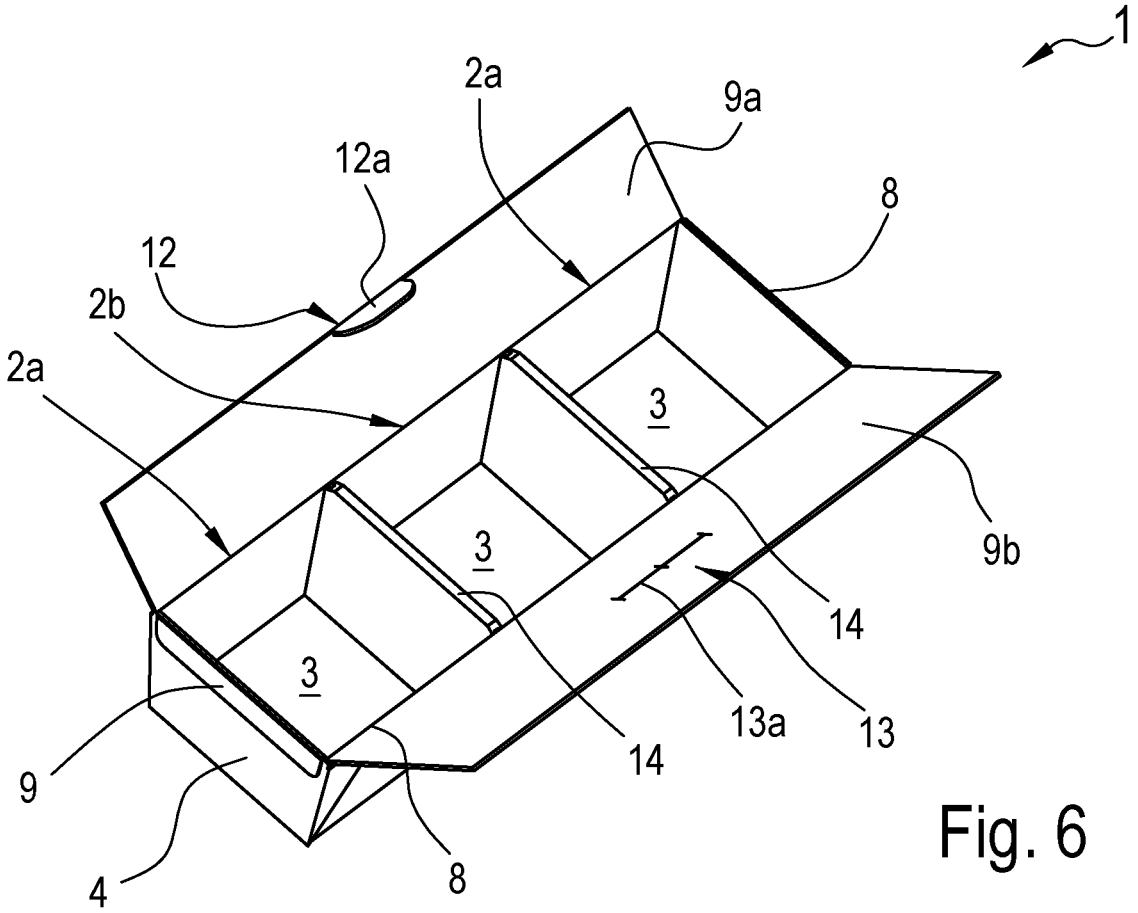
FIG. 6 is a perspective view of an embodiment variant of a container according to the present invention arranged in an open condition.
Figure 11:
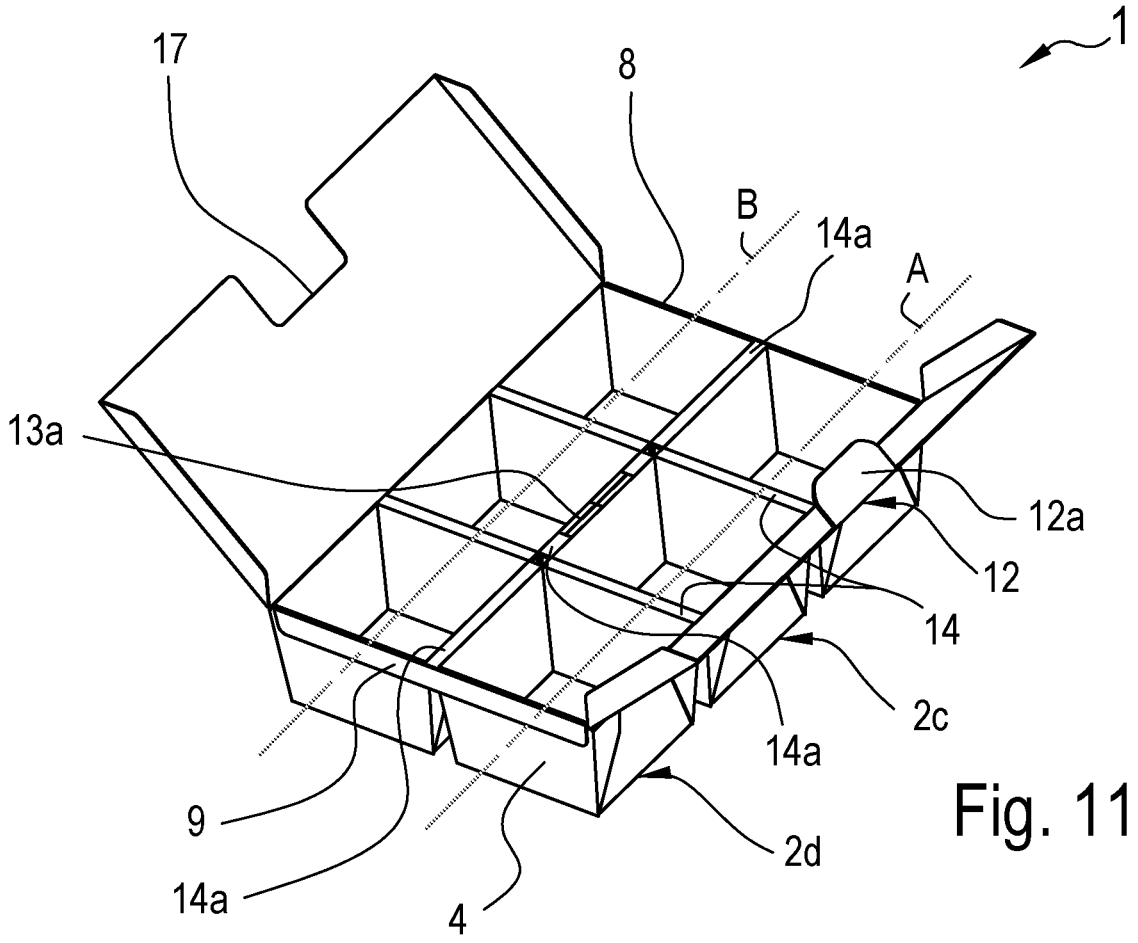
FIG. 11 is a perspective view of a further embodiment variant of a container according to the present invention arranged in an open condition.
Figure 12:
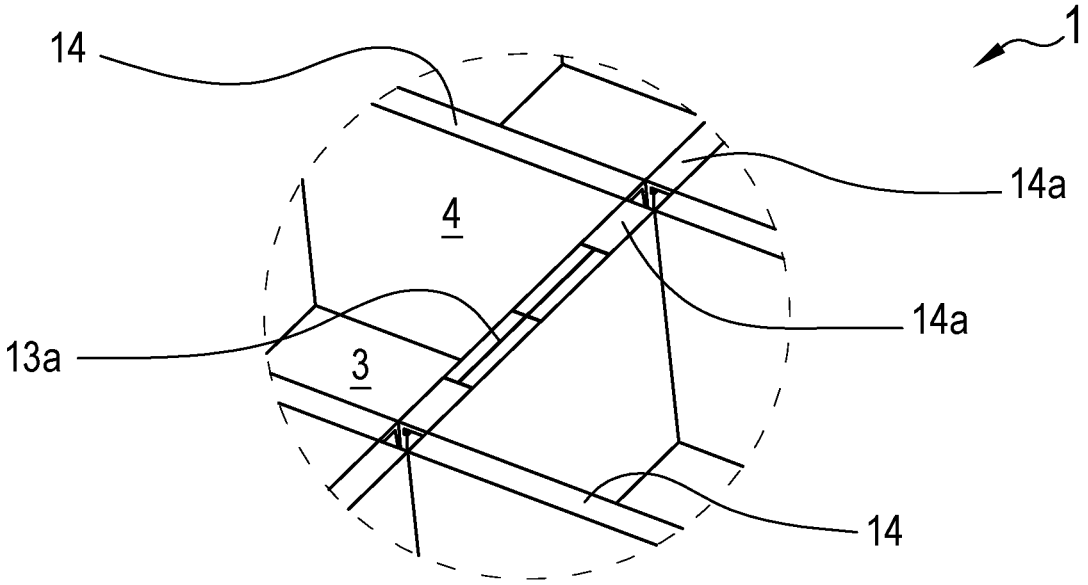
FIG. 12 is a detailed view of the container of FIG. 11.
Figure 17:
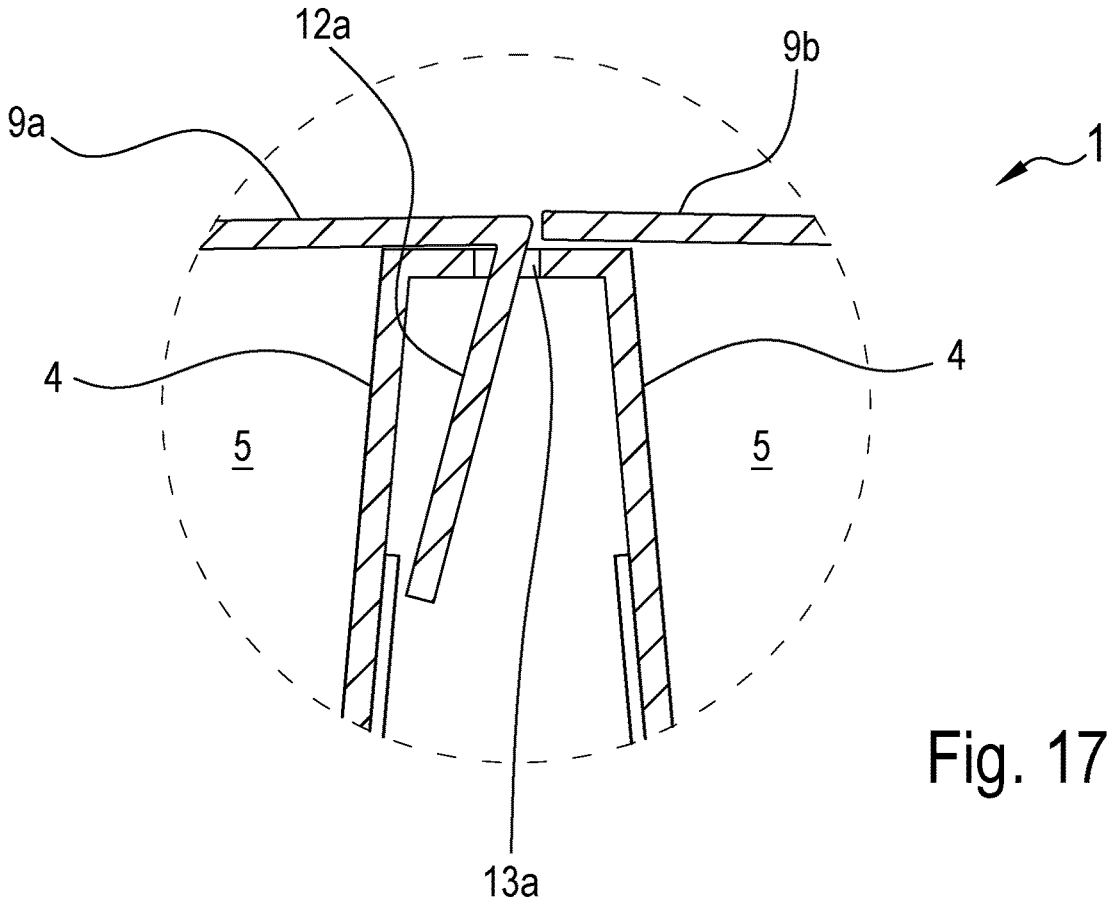

The first coupling portion 12 can comprise at least one tab 12*a* and is stably supported by the at least one panel 9. In particular, the tab 12*a* emerges from an outer profile of the panel 9. Specifically, the first coupling portion 12 is supported by the panel 9 according to the second configuration, in other words when the panel 9 is relatively movable with respect to the outer perimetral edge 8 of the container 1. For example, the first coupling portion 12, particularly the tab 12*a*, can be joined in one piece to the first panel 9*a* as illustrated in FIGS. 6, 11 and 17, for example.

The second coupling portion 13 can comprise a slot 13*a* configured to receive through it the tab 12*a* and enable to lock the tab. The slot 13*a* can be for example defined on a lateral wall 4 of the container 1 (this condition is not illustrated in the attached figures) or can be defined on at least one panel 9. For example, in FIG. 6 the tab 12*a* is supported by the first panel 9*a* while the slot 13*a* is defined on the second panel 9*b*, in particular at a central zone of the second panel 9*b*. The slot 13*a* supported by the second panel 9*b* is configured to enable, in the second operating position of the first and second panels 9*a*, 9*b*, to insert the tab 12*a* in the first coupling portion 12 inside a seat 5 of a hollow element 2 (FIG. 9). In such configuration, the second coupling portion 13 is configured to lock the first panel 9*a* above the second panel 9*b* in order to keep the container in the closed condition.

Figure 14:
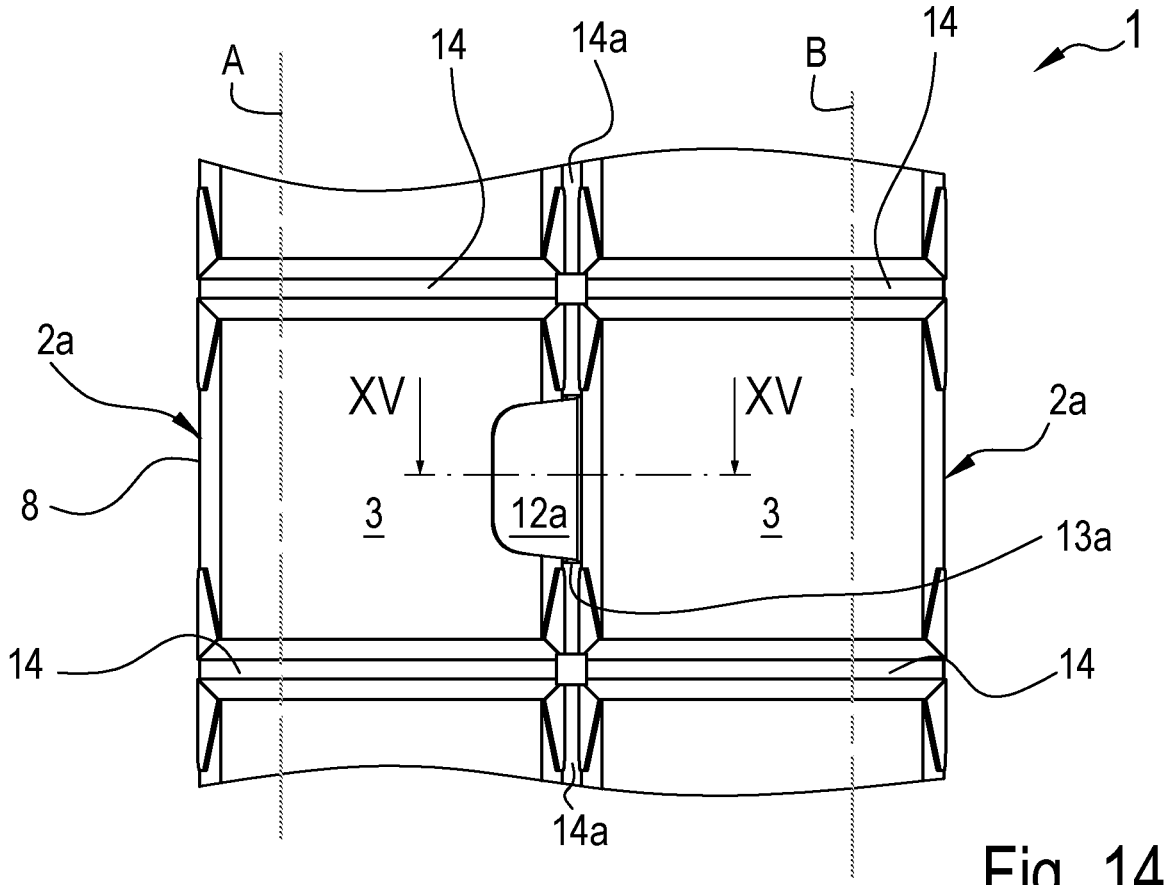
FIG. 14 is a detailed bottom view of the container of FIG. 13.
Figure 15:
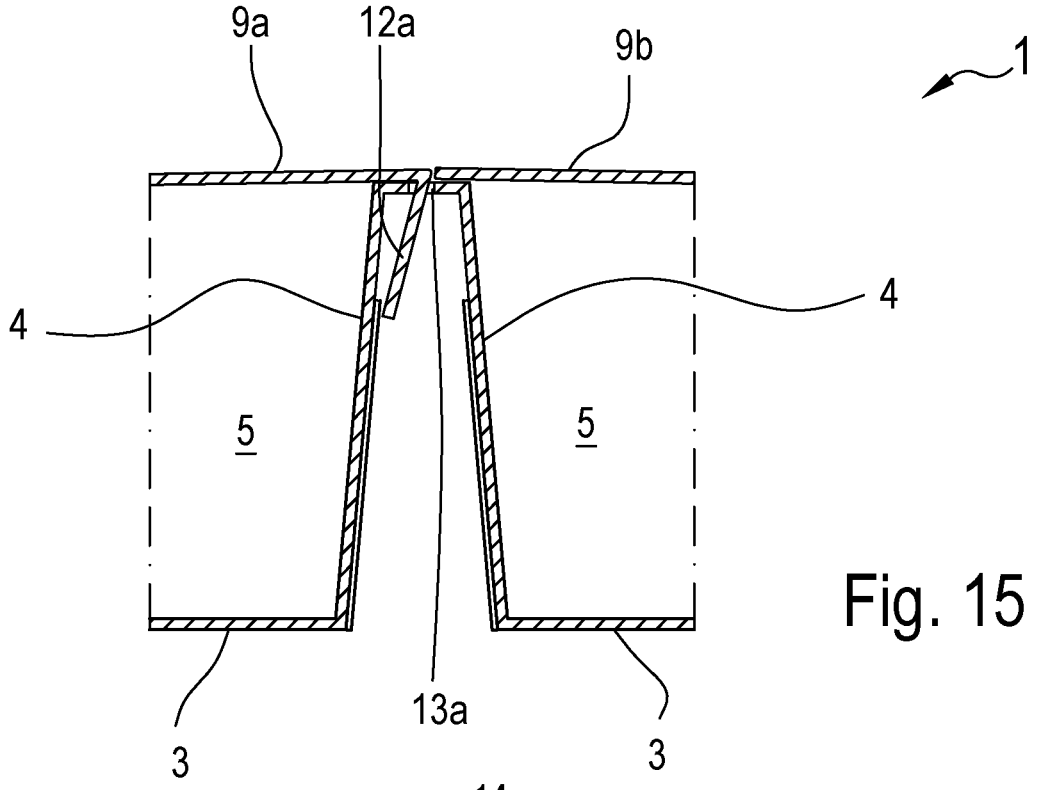
FIG. 15 is a detailed view, according to line XV-XV, of the container in FIG. 14.
Figure 16:
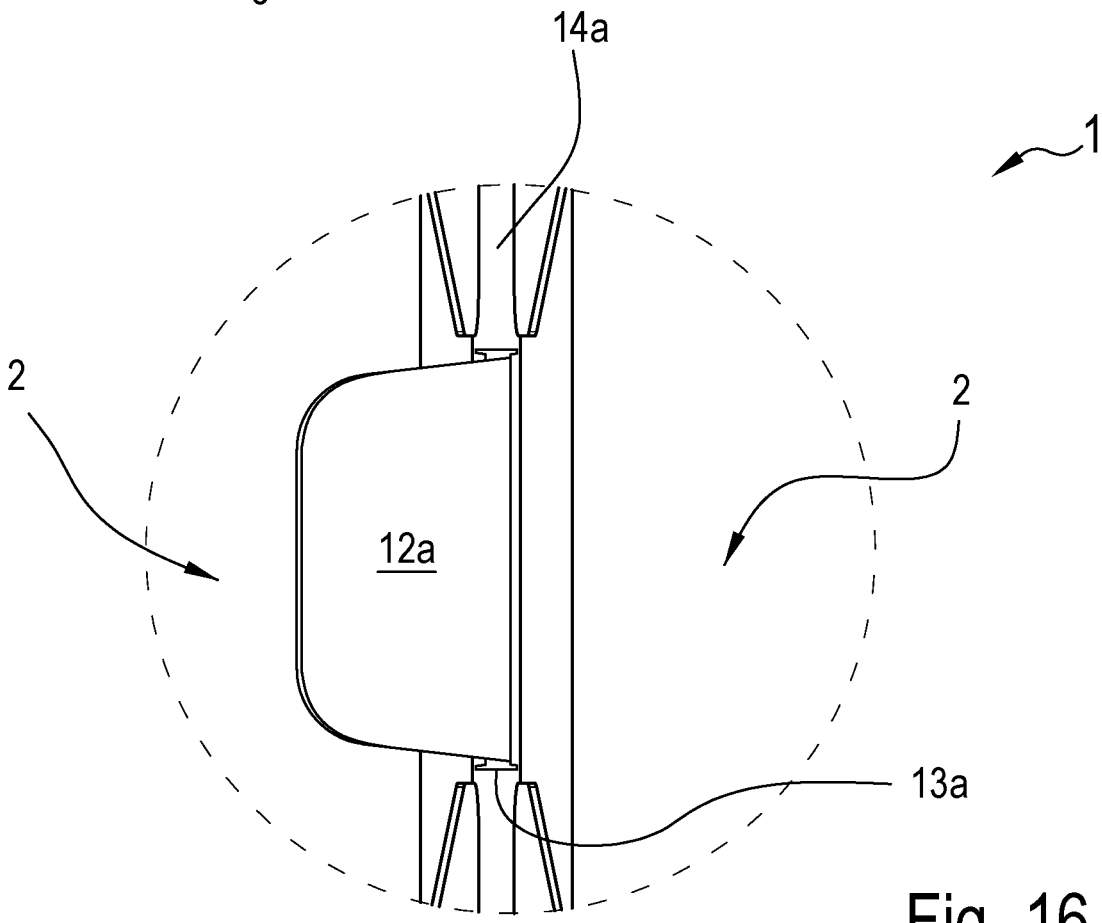
FIGS. 16 and 17 are further detailed views of the container according to FIG. 13.

As an alternative, the second coupling portion 13 can be defined on the intermediate flange 14*a* joining in one piece two series of hollow elements 2 placed side by side. Also in this configuration, the second coupling portion 13 comprises a slot 13*a* carried by the intermediate flange 14*a* and configured to enable, in the second operating position of the first and second panels 9*a*, 9*b*, to position the tab 12*a* of the first coupling portion 12, outside the seats 5 of the hollow elements 2 between the lateral walls 4 of hollow elements 2 adjacent to each other and respectively belonging to the first and second series of hollow elements (see FIGS. 14, 15 and 16, for example). With reference to this latter embodiment described and illustrated in FIG. 11, the second panel 9*b* can comprise a recess 16 configured to enable the first panel 9*a*, at least in the second operating position of the first and second panels 9*a*, 9*b*, to directly face the second coupling portion 13 carried by the intermediate flange 14*a*. The recess 16 can have a convex profile, optionally opened, configured to enable to arrange the second coupling portion 13 inside the recess 16 itself.

Process of Making the Container 1

Moreover, it is an object of the present invention a process of making a container 1 according to the above given description and/or according to any one of the attached claims.

The process of making a container according to the first and second embodiments can comprise at least the following steps:

predisposing a flat blank 50 of paper sheet material (FIG. 5) comprising at least one first and one second trapezoidal shaped sheets 50*a*, 50*b*, each of them comprises at least:

a central sheet 51, a lateral sheet 52 joined in one piece to the central sheet 51 and emerging from a perimetral edge of this latter, wherein the first and second sheets 50*a*, 50*b* are joined in one piece at respective lateral sheets 52, folding the at least one lateral sheet 52 and the central sheet 51 of the first sheet 50*a* with respect to each other in order to define a hollow element 2, folding the at least one lateral sheet 52 and the central sheet 51 of the second sheet 50*b* with respect to each other in order to define a further hollow element 2.

It is useful to observe the blank 50 can have at least one first surface defining, after the step of folding the at least one lateral sheet 52 and central sheet 51, respectively of the first and second sheets 50*a*, 50*b*, a surface of the seat 5 of the hollow element 2 suitable to receive a product P, and also a second surface defining, after the same folding step, an outer surface of the container 1.

The central sheets 51 of the first and second sheets 50*a*, 50*b* define the bases 3 of each hollow element 2. Particularly, the central sheets 51, respectively of the first and second sheets 50*a*, 5*b*, has a polygonal quadrangular shape, wherein from each side of the same quadrangular polygon, emerges at least one lateral sheet 52. In other words, the central sheets 51 of the first and second sheets 50*a*, 50*b* are reciprocally divided by at least one lateral sheet 52 of the first sheet 50*a* and by a lateral sheet 52 of the second sheet 50*b*.

Figure 5:
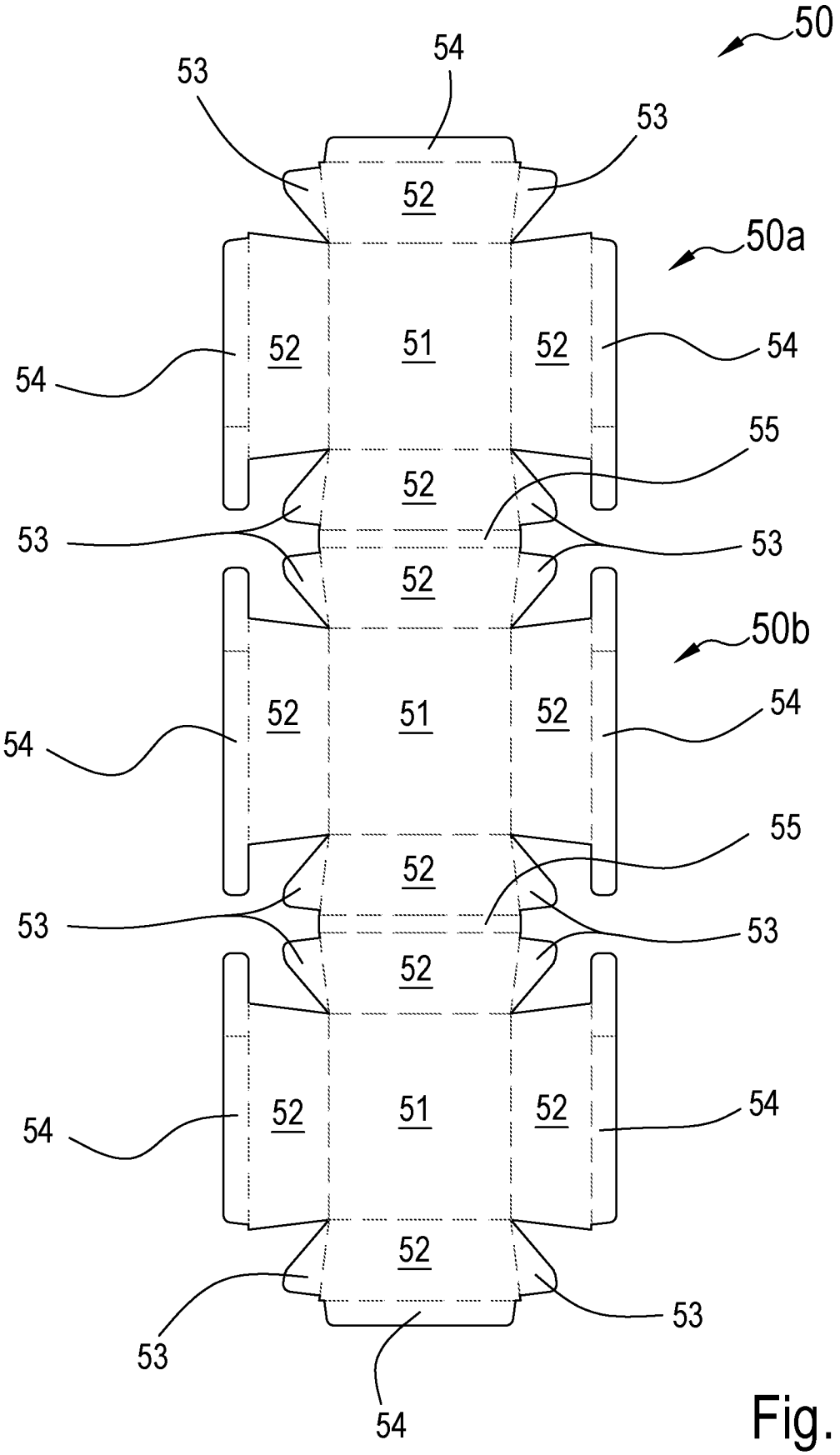
FIG. 5 is a schematic view of a blank for making the container in FIG. 1.

As it is visible in FIG. 5, the first sheet 50*a* can comprise a plurality of lateral sheets 52 emerging from the respective central sheet 51.

The lateral sheets 52 of the first and second sheets 50*a*, 50*b*, after the above cited folding steps, define the lateral walls 4 of the hollow elements 2. Each lateral sheet 52 of the first and second sheets 50*a*, 50*b* is therefore arranged between its central sheet 51 and peripheral sheet 54 respectively of the first and second sheets 50*a*, 50*b*, these latter will be better described in the following detailed description.

Moreover, the first sheet 50*a* comprises at least one lateral connecting sheet 53 carried by at least one of the lateral sheets 52 of the first sheet 50*a* and featuring a triangular shape.

Following the step of folding the lateral sheets 52 with respect to the central sheet 51 of the first sheet 50*a*, the lateral connecting sheet 53 can be constrained, optionally by gluing, to an adjacent lateral sheet 52 in order to stably keep the tridimensional configuration of the hollow element 2.

Further, the first sheet 50*a* can comprise at least one peripheral sheet 54 joined in one piece to at least one lateral sheet 52 of the first sheet 50*a* itself, in order to define, after the step of folding this latter, the at least one panel 9 of the container. Specifically, according to the first and second embodiments of the container (FIG. 5), the first sheet 50*a* can comprise a plurality of peripheral sheets 54 emerging oppositely to the central sheet 51 of the first sheet 50*a*. Consequently, the process can comprise, after or simultaneously with the step of folding the lateral sheets 52, a step of folding each peripheral sheet 54 of the first sheet 50*a* with respect to the lateral sheet 52, so that the second surfaces of the peripheral sheet 54 and of the lateral sheet 52 face and are at least partially in contact with each other.

Moreover, the process can comprise the step of predisposing a tab 56 carried by at least one peripheral sheet 54 and emerging from a perimetral edge delimiting this latter. The tab 56 can be configured to define, after the step of folding the blank, the first coupling portion of the container 1.

Analogously to what was hereinbefore described, the second sheet 50*b* can comprise a plurality of lateral sheets 52 emerging from the respective central sheet 51, and also at least one lateral connecting sheet 53 featuring a triangular shape and carried by at least one of the lateral sheets 52 of the second sheet 50*b*. After the step of folding the lateral sheets 52 with respect to the central sheet 51 of the second sheet 50*b*, the lateral connecting sheet 53 can be constrained, optionally by gluing, to an adjacent lateral sheet 52 in order to stably keep the hollow element 2 in its tridimensional configuration.

Moreover, the second sheet 50*b* can comprise at least one peripheral sheet 54 joined in one piece to at least one lateral sheet 52 of the same second sheet 50*b*, for defining, after the step of folding this latter, the at least one panel 9 of the container.

After the step of folding each peripheral sheet 54 of the first and second sheets 50*a*, 50*b*, the process can further comprise the steps of:

overlapping at least partially a peripheral sheet 54 of the first sheet 50*a* on an adjacent peripheral sheet 54 of the second sheet 50*b*, constraining, by gluing for example, a peripheral sheet 54 of the first sheet 50*a* to an adjacent peripheral sheet 54 of the second sheet 50*b*.

The process further comprises the step of predisposing at least one opening 57 obtained after a step of cutting a peripheral sheet 54 of the second sheet 50*b* opposite to the peripheral sheet 54 supporting the tab 56. The cutting step, performed after the step of folding the blank, defines the slot 13*a* of the second coupling portion 13.

Moreover, the blank 50 can comprise at least one central connecting sheet 55 configured to define, after the step of folding the at least one lateral sheet 52, at least part of a flange 14 of the hollow element 2. The central element 55 can be delimited by a perimetral edge and is joined in one piece to two lateral sheets 52 respectively of the first and second sheets 50*a*, 50*b* along respective opposite segments of the perimetral edge of the connecting sheet 55.

The blank 50 can further comprise at least one third and fourth sheets 50*c*, 50*d* made according respectively to the first and second sheets 50*a*, 50*b* of the same blank 50, and also at least one joining sheet 58 configured to join in one piece the first, second, third and fourth sheets 50*a*, 50*b*, 50*c*, 50*d* to each other along a perimetral edge delimiting the same joining sheet 58. Specifically, the joining sheet 58 comprises a first and second joining sheets 58*a*, 58*b* respectively joined in one piece to the first and third sheets 50*a*, 50*c* and to the second and fourth sheets 50*b*, 50*d*. The first joining sheet 58*a* is joined in one piece to respective lateral sheets 52 of the first and third sheets 50*a*, 50*c* along a first segment of the perimetral edge of the joining sheet 58. Vice versa, the second joining sheet 58*b* is joined in one piece to respective lateral sheets 52 of the second and fourth sheets 50*b*, 50*d* along a second segment of the perimetral edge of the joining sheet 58, opposite to the first segment, in order to define, after the step of folding each lateral sheet 52, the intermediate flange 14*a*. Moreover, the at least one joining sheet 58 can comprise an opening 57 obtained after at least one step of cutting this latter, for defining the slot 13*a* of the second coupling portion 13.

Moreover, the process comprises the step of cutting a peripheral sheet 54 of the blank 50 for defining the recess 16.

Package 100

It is also an object of the present invention a package 100 for housing a container 1 according to the above given description and/or according to any one of the attached claims.

The package 100 can comprise at least one case of sheet material, optionally made of at least one among: plastics, aluminum, or paper, featuring a housing compartment 22 having a substantially closed volume, configured to hold the container 1. As it is visible in FIG. 18, the case 17 comprises at least one end closure portion 18 joined in one piece by a lateral wall 19 for defining a tubular element receiving inside said container 1. In particular, the at least one end closure portion 18 of the case 17 comprises a first and second end closure portions 18*a*, 18*b* opposite to each other and configured to engage each other in order to occlude the housing compartment 22 of the case and to prevent the container 1 from being withdrawn from this latter.

Figure 7:
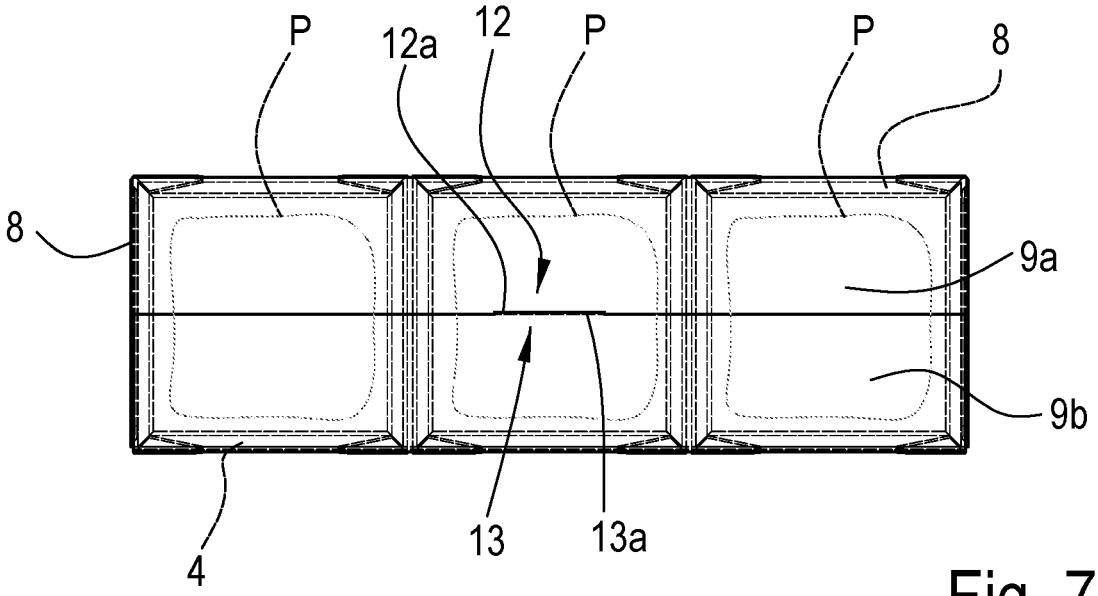
FIGS. 7 and 8 illustrate the container of FIG. 6 arranged in a closed condition.

It is useful to observe, as for example shown in FIGS. 7 and 9, that the container, once arranged inside the housing compartment 22, contains at least one product P, optionally of a food type.

Figure 18:
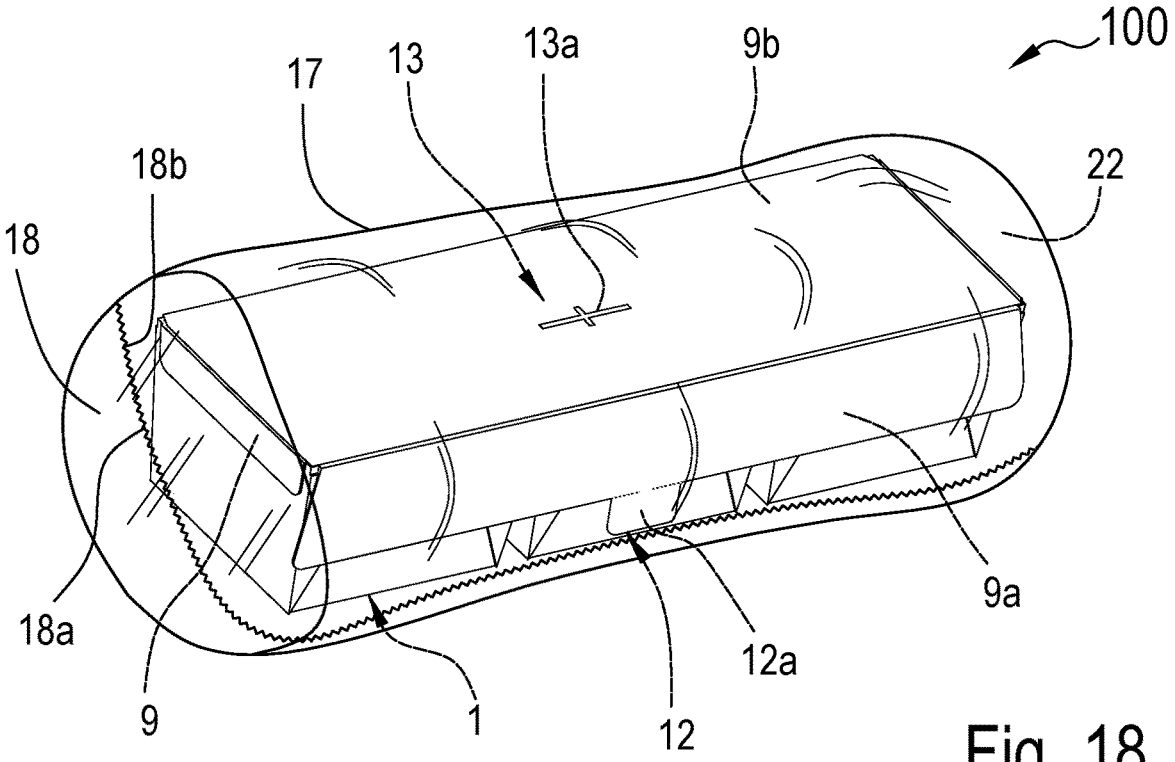
FIG. 18 is a perspective view of a package according to the present invention.
Figure 19:
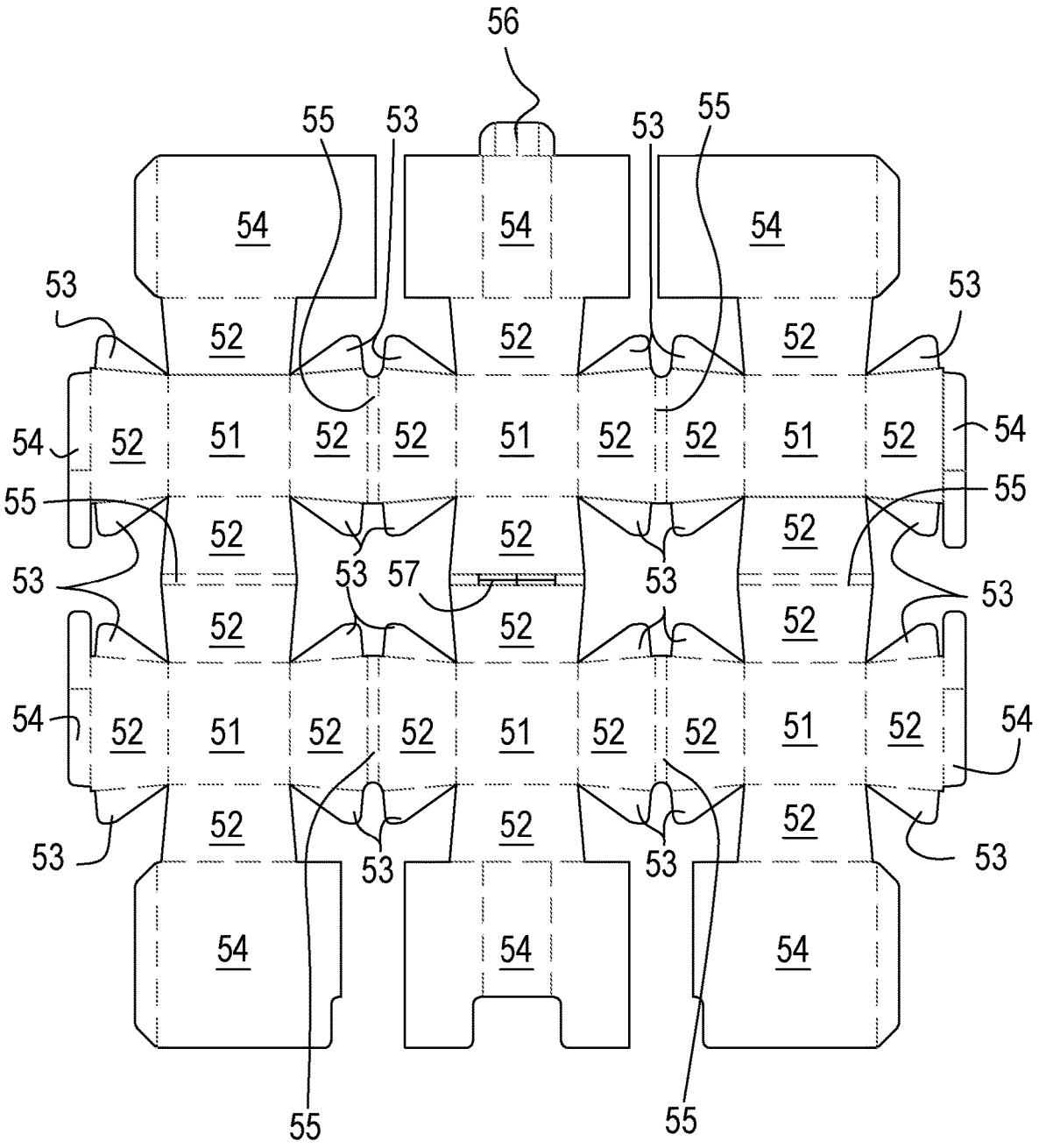
FIG. 19 is a schematic view of a blank for making the container illustrated in Figure from 11 to 17.

FIG. 18 shows a configuration of the package 100 wherein the container 1 is arranged inside the housing compartment 22 of this latter, featuring the second panel 9*b*, on which it is defined the second coupling portion 13 in the second operating position, which completely occludes the access to the seats 5 of each hollow element 2. Vice versa, the first panel 9*a* supporting the first coupling portion 12, is arranged in the first operating position placed side by side to the lateral wall 4, configured to increase the structural rigidity of the inside of container 1.

Process of Making the Package 100

Moreover, it is an object of the present invention a process of making a package 100 according to the above given description and/or according to any one of the attached claims.

The process of making a package 100 comprises at least the steps of making a container 1 by a process according to the above given description, and also of predisposing at least one product, optionally of a food type, inside at least one hollow element of the container 1.

Further, the process comprises predisposing a case 17, comprising a flat sheet at least partially of plastic material, by which, after a step of folding this latter, a tubular element featuring two end openings 18 opposite to each other is obtained. After the step of defining the tubular element, the process further provides to insert the container 1 inside the tubular element, followed by a step of constraining the tubular element itself at the end openings 18. Performing the step of constraining the tubular element, comprising a step of heat sealing both the end openings 18, allows to define the closed end portions of the case 17, these latter being configured to prevent the container 1 from being withdrawn from the case 17 unless the same case 17 is broken.

The invention claimed is:

1. Container for housing one or more products is made by folding a single flat blank made of paper sheet material, said container comprising a plurality of hollow elements joined together in one piece, each hollow element of said plurality of hollow elements comprising:

a base, a lateral wall emerging from the base and defining with the base a seat configured to receive at least one product, the lateral wall defining an opening delimited by a free edge and configured to allow the introduction and withdrawal of the at least one product from said seat, an outer edge with a closed profile, opposed to the bases of the plurality of hollow elements and delimiting an upper access of the container, in which the seats of the plurality of hollow elements are defined within said outer edge, at least one panel joined in one piece to at least one part of the outer edge of the container, wherein said panel is placed at least partly outside the seats of the plurality of hollow elements, and wherein the panel is fixed to the lateral wall at an area distinct and distanced from the outer edge.

2. The container according to claim 1, further comprising a first hollow element of said plurality of hollow elements which includes at least one flange extending externally to the seat starting from the free edge of the lateral wall of said first hollow element, said flange of the first hollow element being joined in one piece to a second hollow element of said plurality of hollow elements adjacent to said first hollow element, the lateral wall of the first hollow element is interposed between the flange and the base of the same first hollow element, wherein the second hollow element comprises a flange extending outside the seat starting from the free edge of the lateral wall of said second hollow element approaching the first hollow element, wherein the flange of the first hollow element is joined in one piece to the flange of the second hollow element, the lateral wall of the second hollow element is interposed between the flange and the base of the second hollow element.

3. The container according to claim 1, wherein the panel is directly constrained, to the lateral wall of at least one hollow element, wherein the panel lies on a plane parallel to a lying plane of the lateral wall directly carrying said panel to which said panel is directly joined in one piece.

4. The container according to claim 1, wherein the panel is stably fixed to the lateral wall directly carrying said panel by means of glue portions.

5. The container according to claim 1, wherein a portion of the panel is distanced from the outer edge and constrained to the lateral wall directly carrying said panel.

6. The container according to claim 1, wherein the panel is stably constrained to the lateral wall directly carrying said panel at two areas:

at the outer edge;

at a substantially central area of the panel.

7. The container according to claim 1, wherein the panel comprises a first and a second panel connected at opposite sides of the outer edge.

8. The container according to claim 1, wherein the outer edge has a quadrilateral shape, wherein the container comprises a panel for each side of the outer edge.

9. The container according to claim 1, wherein the panel is fixed to two or more lateral walls of adjacent hollow elements of the container.

10. The container according to claim 1, wherein the panel is hinged to at least one section of the outer edge, said panel and the outer edge are relatively movable by rotation, between:

a first operating position in which the panel allows communication between the openings of the plurality of hollow elements and the external environment to define an opening condition of the container to allow the withdrawal and insertion of products, a second operating position in which the panel is arranged above the openings of the plurality of hollow elements partly occluding the openings to define a closing condition of the container suitable to prevent the removal from and insertion of products into said aperture.

11. The container according to claim 10, wherein the panel comprises a first coupling portion, wherein the container comprises a second coupling portion configured to cooperate with the first coupling portion of the panel in the second operating condition of the panel, wherein the first and second coupling portions, in the second operating position of the panel, are configured to engage each other to lock the panel in the second operating position and thus keep the container in the closed condition.

12. The container according to claim 11, wherein the first coupling portion comprises a tab, the second coupling portion comprising a slot which, in the second operating position of the panel, receives through the tab of the first coupling portion, wherein the slot of the second coupling portion is distinct and distanced from the free edge of each hollow element.

13. The container according to claim 11, wherein:

the first coupling portion is carried by the panel, the second coupling portion is defined on one flange joining in one piece at least two adjacent hollow elements, wherein the slot of said second coupling portion, is configured to allow, in the second operating portion of the panel, the positioning of the tab of the first coupling portion outside the seats of the hollow elements in interposition between the lateral walls of adjacent hollow elements.

14. The container according to claim 10, wherein the panel comprises a first and a second panel which, in the second operating position, are partly superimposed on each other and configured to completely occlude the openings of the plurality of hollow elements.

15. The container according to claim 14, wherein:

the first coupling portion is carried by the first panel, the second coupling portion is carried by the second panel, wherein the slot of said second coupling portion carried by the second panel is configured to allow, in the second operating position of the first and second panels, the insertion of the tab of the first coupling portion inside a seat of a hollow element.

16. The container according to claim 15, wherein the first coupling portion comprises a tab joined in one piece to the first panel, wherein the tab emerges from an outer profile of the first panel.

17. The container according to claim 10, wherein the container comprises a first and a second series of hollow elements, each of them comprises a plurality of hollow elements, wherein:

the hollow elements of the first series are aligned along a first trajectory, the hollow elements of the second series are aligned along a second trajectory, wherein said first and second trajectories are substantially parallel to each other, wherein the container comprises an intermediate flange joining in one piece the plurality of hollow elements of the first and second series of hollow elements at the free edges of the hollows elements of said first and second series, wherein the panel comprises a first coupling portion, the container comprises a second coupling portion configured to cooperate with the first coupling portion of the panel in the second operating condition of the panel, wherein the first and second coupling portions, in the second operating position of the panel, are configured to engage each other to lock the panel in the second operating position and thus keep the container in the closed condition, and the first coupling portion is carried by the panel, the second coupling portion is defined on one flange joining in one piece at least two adjacent hollow elements, wherein the second coupling portion is defined on the intermediate flange, wherein the slot of the second coupling portion, is configured to allow, in the second operating position of the first and second panels, the positioning of the tab of the first coupling portion outside the seats of each hollow elements in interposition between the first and second series.

18. The container according to claim 1, wherein the container comprises a first and a second series of hollow elements, each of them comprises a plurality of hollow elements, wherein:

the hollow elements of the first series are aligned along a first trajectory, the hollow elements of the second series are aligned along a second trajectory, wherein said first and second trajectories are substantially parallel to each other, wherein the container comprises an intermediate flange joining in one piece the plurality of hollow elements of the first and second series of hollow elements at the free edges of the hollows elements of said first and second series.

19. Container for housing one or more products, said container comprising a plurality of hollow elements joined together in one piece, each hollow element of said plurality of hollow elements comprising:

a base, a lateral wall emerging from the base and defining with the base a seat configured to receive at least one product, the lateral wall defining an opening delimited by a free edge and configured to allow the introduction and withdrawal of the at least one product from said seat, an outer edge with a closed profile, opposed to the bases of the plurality of hollow elements and delimiting an upper access of the container, in which the seats of the plurality of hollow elements are defined within said outer edge, at least one panel joined in one piece to at least one part of the outer edge of the container, wherein said panel comprises a first coupling portion and is placed at least partly outside the seats of the plurality of hollow elements, a second coupling portion configured to cooperate with the first coupling portion of the panel in a second operating condition of the panel, wherein the panel is hinged to a section of the outer edge, said panel and the outer edge are relatively movable by rotation, between:

a first operating position in which the panel allows communication between the openings of the plurality of hollow elements and the external environment to define an opening condition of the container to allow the withdrawal and insertion of products, the second operating position in which the panel is arranged above the openings of the plurality of hollow elements partly occluding the openings to define a closing condition of the container suitable to prevent the removal from and insertion of products into said aperture, wherein the first and second coupling portions, in the second operating position of the panel, are configured to engage each other to lock the panel in the second operating position and thus keep the container in the closed condition, wherein the container is made by folding a single flat blank made of paper sheet material.

20. Container for housing one or more products made by folding a single flat blank made of paper sheet material, said container comprising a plurality of hollow elements joined together in one piece, each hollow element of said plurality of hollow elements comprising:

a base, a lateral wall emerging from the base and defining with the base a seat configured to receive at least one product, the lateral wall defining an opening delimited by a free edge and configured to allow the introduction and withdrawal of the at least one product from said seat, an outer edge with a closed profile, opposed to the bases of the plurality of hollow elements and delimiting an upper access of the container, in which the seats of the plurality of hollow elements are defined within said outer edge, at least one panel joined in one piece to at least one part of the outer edge of the container, wherein said panel is placed at least partly outside the seats of the plurality of hollow elements, wherein the panel is directly constrained to the lateral wall of at least one hollow element, wherein the panel lies on a plane parallel to a lying plane of the lateral wall directly carrying said panel to which said panel is directly joined in one piece.

* * * * *